US005942846A

United States Patent [19]

Honda et al.

[11] Patent Number: 5,942,846

[45] Date of Patent: Aug. 24, 1999

[54] DEFLECTION YOKE WITH HORIZONTAL DEFLECTION COIL

[75] Inventors: Masanobu Honda, Osaka; Koji Shimada, Shiga, both of Japan

[73] Assignee: Matsushita Electronics Corporation, Osaka, Japan

[21] Appl. No.: 09/027,851

[22] Filed: Feb. 23, 1998

Related U.S. Application Data

[62] Division of application No. 08/884,321, Jun. 27, 1997, Pat. No. 5,859,495.

[51] Int. Cl.[6] ..... H01J 29/76

[52] U.S. Cl. ..... 313/440; 313/426; 335/213

[58] Field of Search ..... 313/413, 426, 313/431, 440; 335/210, 213, 299

[56] References Cited

U.S. PATENT DOCUMENTS

| | | | |
|---|---|---|---|
| 3,027,500 | 3/1962 | Smith | 335/212 |
| 3,488,541 | 1/1970 | Barbin | 335/213 |
| 3,895,329 | 7/1975 | Logan et al. | 335/210 |
| 4,143,346 | 3/1979 | Borkar et al. | 335/213 |
| 4,229,720 | 10/1980 | Heijnemans et al. | 335/213 |
| 4,233,582 | 11/1980 | Abe et al. | 335/213 |
| 4,755,714 | 7/1988 | Sluyterman | 313/440 |
| 5,077,533 | 12/1991 | Klingelhofer | 335/213 |
| 5,166,576 | 11/1992 | Roussel et al. | 313/413 |
| 5,408,163 | 4/1995 | Milili et al. | 335/213 |

FOREIGN PATENT DOCUMENTS

| | | | |
|---|---|---|---|
| 0 169 613 | 1/1986 | European Pat. Off. | H01J 29/236 |
| 2-216738 | 8/1990 | Japan | H01J 29/76 |
| 4-209449 | 7/1992 | Japan | H01J 29/76 |

OTHER PUBLICATIONS

Communication from European Patent Office and attached Search Report, Dec. 21, 1995.

*Primary Examiner*—Michael Day
*Attorney, Agent, or Firm*—Merchant & Gould P.C.

[57] ABSTRACT

A deflection yoke is formed with a saddle shaped horizontal deflection coil (85), a saddle shaped vertical deflection coil (86) located outside the horizontal deflection coil (85), and a ferrite core (87) located outside the vertical deflection coil (86). The screen side flange portion (82) of the horizontal deflection coil (85) has a gap (83) therethrough in the upper and lower direction. The screen side flange portion (82) is an arch-shaped portion provided at a screen side end of the horizontal deflection coil (85).

2 Claims, 28 Drawing Sheets

DEFLECTION YOKE WITH HORIZONTAL DEFLECTION COIL

This is a divisional application of Ser. No. 08/884,321, filed Jun. 27, 1997, now U.S. Pat. No. 5,859,495.

BACKGROUND OF THE INVENTION

1. Field of the Invention

The present invention relates to deflection yokes and color cathode ray tubes with the deflection yokes.

2. Description of the Related Art

In the current color cathode ray tubes used as a display monitor such as windows, information is very often displayed in the peripheral regions of the screen. Therefore a technology enabling minute image display in such regions is being required.

Since the raster distortion is one of the important elements in determining the image quality in the peripheral regions of the screen, the standard for the raster distortion of the screen, which depends on the magnetic field distribution of the deflection yoke itself, has become very demanding.

In general, the magnetic field distribution at the screen side cone portion of a saddle shaped coil used as a horizontal deflection coil is designed to include a strong pincushion distortion in order to eliminate the raster distortion at the upper and lower edges of the screen. However, when it includes significant fifth-order pincushion distortion, an upper and lower high order raster distortion called gullwing emerges. Since a high order raster distortion such as the gullwing deteriorates the visual image quality drastically, it should be prevented.

In general, the vertical magnetic field distribution of a deflection yoke used in a color cathode ray tube for display monitoring has a barrel distortion entirely from the electron gun side to the screen side with respect to the self-convergence. Then, since the raster distortion at the right and left edges of the screen has a pincushion shape when such a barrel distortion is included, the distortion is eliminated by supplying a correction current from the circuit side of the display monitor toward the horizontal deflection coil. However, since the correction current in general has a wave form to correct a third-order pincushion distortion, when a raster distortion at the right and left edges of the screen includes a gullwing which is a high order distortion, the correction current can not completely eliminate the distortion. On the other hand, as mentioned above, since the gullwing drastically deteriorates the visual image quality, it should be prevented.

In order to meet such requirements, a method of reducing a high order raster distortion such as a gullwing at the upper and lower edges of the screen by forming a dent toward the central axis of the cathode ray tube at the center of the screen side flange portion of the horizontal deflection coil is proposed in U.S. Pat. No. 4,233,582. Another method of reducing the gullwing at the upper and lower edges of the screen by having the screen side flange portion of the horizontal deflection coil of a polygonal shape is advocated in U.S. Pat. No. 4,229,720. By analogy, these methods can be applied to a vertical deflection coil to reduce the gullwing at the right and left edges of the screen. Further, a method of reducing a high order raster distortion by forming a projection toward the electron gun side at the right and left edges of the screen side flange portion of a saddle shaped coil is proposed in Japanese Patent Application Laid Open No. 216738/1990.

However, in the method disclosed in U.S. Pat. No. 4,233,582, in the pressing process to provide a dent toward the central axis of the cathode ray tube at the center of the screen side flange portion of a horizontal deflection coil or a vertical deflection coil, there is a problem that it is highly likely that the insulating coating layer of a coil wire is damaged due to the excessive stretching of the coil wire in production. Further, if the dent is formed too deep, since the dent comes in contact with the funnel portion of the cathode ray tube when the deflection yoke is attached to the cathode ray tube, there is a problem in production or designing in that it is sometimes difficult to form a dent sufficient to remove a high order raster distortion such as the gullwing. Further, if a dent is formed too deep, since the dent comes in contact with the cone portion of the horizontal deflection coil when assembling the deflection yoke, there is a problem in production or designing in that it is sometimes difficult to form a dent sufficient to remove the gullwing. Further, in the method disclosed in U.S. Pat. No. 4,229,720, there is a problem in production in that coil wires are liable to be deformed and damaged at the apexes of the polygon-shaped screen side flange portion of the horizontal deflection coil or the vertical deflection coil.

In general, a ferrite core is used in a deflection yoke to strengthen the deflection magnetic field strength but the ferrite core also alleviates the magnetic field distortion formed by the deflection coil itself (hereinafter abbreviated ferrite core effect on the field distribution). Therefore even if the horizontal magnetic field distortion is controlled by the winding distribution of the deflection coil to minimize the deflection aberration, since the magnetic field distortion is alleviated by the ferrite core effect on the field distribution of the ferrite core, there is a problem that the correction sensitivity of the deflection aberration deteriorates to that extent.

In the method disclosed in Japanese Patent Application Laid Open No. 216738/1990, in the pressing process to provide a projection at the right and left edges of the screen side flange portion of the saddle shaped coil, there is a problem in that it is highly likely that the insulation coating layer of a coil wire is damaged due to the excessive stretching of the coil wire in production. Further, if the projection is formed too high, since the horizontal deflection coil, the vertical deflection coil and the ferrite core come in contact with each other when the deflection yoke is assembled, there is a problem in production or designing in that it is difficult to form a projection sufficient to remove a high order raster distortion.

SUMMARY OF THE INVENTION

In order to solve the above mentioned problems of conventional arts , an object of the present invention is to provide a deflection yoke which can sufficiently decrease a gullwing without the risk of damaging coil wires of the screen side flange portion at the time of winding of the horizontal deflection coil or the vertical deflection coil. Another object of the present invention is to provide a deflection yoke which can sufficiently decrease a high order raster distortion without the risk of damaging the coil wires of the screen side flange portion of the saddle shaped coil at the time of wiring the saddle shaped coil, or contacting the horizontal deflection coil, the vertical deflection coil and the ferrite core with each other at the time of assembling the deflection yoke. It is a further object of the present invention to provide a deflection yoke which can sufficiently decrease a high order raster distortion without the risk of damaging the coil wires of the screen side flange portion at the time of winding the saddle shaped coil or the horizontal deflection coil, or contacting the saddle shaped coil or the horizontal deflection coil to the glass funnel at the time of attaching the deflection yoke. It is another object of the present invention to provide a color cathode ray tube which can sufficiently decrease a high order raster distortion such as the gullwing to improve the image quality.

In order to achieve the above mentioned objects, a first aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein the screen side cone portion of at least one selected from the group consisting of the saddle shaped horizontal deflection coil and the saddle shaped vertical deflection coil projects to a position not affected by the ferrite core effect on the field distribution of the core.

A first aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein the screen side cone portion of at least one selected from the group consisting of the saddle shaped horizontal deflection coil and the saddle shaped vertical deflection coil projects to a position not affected by the ferrite core effect on the field distribution of the core.

In the above mentioned first aspect of deflection yokes of the present invention, it is preferable that the head point in the direction of screen side tube axis of the screen side cone portion of the horizontal deflection coil is located in the range of from 20 mm to 60 mm away from the screen side tip portion of of the core. The head point in the direction of screen side tube axis of the screen side cone portion of the horizontal deflection coil herein refers to the top portion of the projection of the screen side cone portion at the point crossing the tube axis.

In the above mentioned first aspect of deflection yokes of the present invention, it is preferable that the screen side cone portion of the horizontal deflection coil is wound in the winding angle range from 1° to 80° with a higher density of winding distribution in the range from 18° to 30° with the horizontal axis as the standard.

In the above mentioned first aspect of color cathode ray tubes of the present invention, it is preferable that the head point in the direction of screen side tube axis of the screen side cone portion of the horizontal deflection coil is located in the range of from 20 mm to 60 mm away from the screen side tip portion of of the core.

In the above mentioned first aspect of color cathode ray tubes of the present invention, it is preferable that the screen side cone portion of the horizontal deflection coil is wound in the winding angle range from 1° to 80° with a higher density of winding distribution in the range from 18° to 30° with the horizontal axis as the standard.

In the above mentioned first aspect of deflection yokes of the present invention, it is preferable that the head point in the direction of screen side tube axis of the screen side cone portion of the vertical deflection coil is located in the range of from 10 mm to 60 mm away from the screen side tip portion of the core.

In the above mentioned first aspect of deflection yokes of the present invention, it is preferable that the screen side cone portion of the vertical deflection coil is wound in the winding angle range from 1° to 80° with a higher density of winding distribution in the range from 18° to 30° with the vertical axis as the standard.

In the above mentioned first aspect of color cathode ray tubes of the present invention, it is preferable that the head point in the direction of screen side tube axis of the screen side cone portion of the vertical deflection coil is located in the range of from 10 mm to 60 mm away from the screen side tip portion of the core.

In the above mentioned first aspect of color cathode ray tubes of the present invention, it is preferable that the screen side cone portion of the vertical deflection coil is wound in the winding angle range from 1° to 80° with a higher density of winding distribution in the range from 18° to 30° with the vertical axis as the standard.

A second aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a projection toward the screen side.

A third aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a dent toward the electron gun side.

In the above mentioned second or third aspect of deflection yokes of the present invention, it is preferable that the surface of the screen side flange portion of one selected from the group consisting of the saddle shaped horizontal deflection coil and the saddle shaped vertical deflection coil opposing to a glass funnel portion of a color cathode ray tube conforms to the surface shape of the opposing glass funnel portion.

A second aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a projection toward the screen side.

A third aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a dent toward the electron gun side.

In the above mentioned second or third aspect of color cathode ray tubes of the present invention, it is preferable that the surface of the screen side flange portion of one selected from the group consisting of the saddle shaped horizontal deflection coil and the saddle shaped vertical deflection coil opposing to the glass funnel portion of a color cathode ray tube conforms to the surface shape of the opposing glass funnel portion.

A fourth aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil wherein the screen side flange portion of one selected from the group consisting of the saddle shaped horizontal deflection coil and the saddle shaped vertical deflection coil has a smoothly curved contour and the ratio r=c/d (c: the maximum width, d: the maximum height) is set in the range of from 2.2 to 3.5.

A fourth aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil wherein the screen side flange portion of one selected from the group consisting of the saddle shaped horizontal deflection coil and the saddle shaped vertical deflection coil has a smoothly curved contour and the ratio r=c/d (c: the maximum width, d: the maximum height) is set in the range of from 2.2 to 3.5.

A fifth aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein a gap is formed through the screen side flange portion of the horizontal deflection coil in the upper and lower direction.

A fifth aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein a gap is formed through the screen side flange portion of the horizontal deflection coil to the upper and lower direction.

Since the above mentioned first aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein the screen side cone portion of at least one selected from the group consisting of the saddle shaped horizontal deflection coil and the saddle shaped vertical deflection coil projects to a position not affected by the ferrite core effect on the field distribution of the core, wherein the screen side cone portion of at least one selected from the group consisting of the saddle shaped horizontal deflection coil and the saddle shaped vertical deflection coil projects to a position not having the ferrite core effect on the field distribution of the core, if the condition of horizontal magnetic field distortion or the vertical magnetic field distortion to minimize the high order raster distortion (gullwing) at the upper and lower edges or the right and left edges of the screen is achieved, the gullwing can be effectively reduced. Further, since the gullwing can be reduced effectively, the screen side flange portion of the horizontal deflection coil or the vertical deflection coil can be formed in approximately a circular shape without forming a dent in the screen side flange portion of the horizontal deflection coil or the vertical deflection coil, or having a polygon shaped screen side flange portion of the horizontal deflection coil or the vertical deflection coil as in conventional arts. As a result, problems such as the damage in production to the coil wires of the screen side flange portion at the time of winding the horizontal deflection coil or the vertical deflection coil can be prevented.

Since the above mentioned first aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein the screen side cone portion of at least one selected from the group consisting of the saddle shaped horizontal deflection coil and the saddle shaped vertical deflection coil projects to a position not affected by the ferrite core effect on the field distribution of the core, the following advantages can be achieved. That is, since a deflection yoke of the first aspect of the present invention is used effectively to reduce the gullwing as mentioned above, the image quality of the color cathode ray tube can be improved.

In the above mentioned preferable embodiment of the first aspect of deflection yokes of the present invention in which the head point in the direction of screen side tube axis of the screen side cone portion of the horizontal deflection coil is located in the range of from 20 mm to 60 mm away from the screen side tip portion of the core, the ferrite core effect on the field distribution of the core to the screen side cone portion of the horizontal deflection coil becomes smaller.

In the above mentioned preferable embodiment of the first aspect of deflection yokes of the present invention in which the screen side cone portion of the horizontal deflection coil is wound in the winding angle range from 1 to 80° with a higher density of winding distribution in the range from 18° to 30° with the horizontal axis as the standard, the condition of horizontal magnetic field distortion to minimize the gullwing can be easily achieved. This is because the fifth-order pincushion distortion, which generates gullwing, emerges at the wires at the screen side cone portion of the horizontal deflection coil which is wound in the winding angle range from 1° to 18° with the horizontal axis as the standard. By comparatively reducing the winding distribution at the winding angle from 1° to 18° , the fifth-order pincushion distortion can be decreased to curb the generation of the gullwing.

In the above mentioned preferable embodiment of the first aspect of color cathode ray tubes of the present invention in which the head point in the direction of screen side tube axis of the screen side cone portion of the horizontal deflection coil is located in the range of from 20 mm to 60 mm away from the screen side tip portion of the core, since the gullwing can be effectively reduced as mentioned above, the image quality of the color cathode ray tube can be improved.

In the above mentioned preferable embodiment of the first aspect of color cathode ray tubes of the present invention in which the head point in the direction of screen side tube axis of the screen side cone portion of the vertical deflection coil is located in the range of from 10 mm to 60 mm away from the screen side tip portion of the core, the ferrite core effect on the field distribution of the core to the screen side cone portion of the vertical deflection coil becomes smaller.

In the above mentioned preferable embodiment of the first aspect of deflection yokes of the present invention in which the screen side cone portion of the vertical deflection coil is wound in the winding angle range from 1° to 80° with a higher density of winding distribution in the winding angle range from 18° to 30° with the vertical axis as the standard, the condition of vertical magnetic field distortion to minimize a high order raster distortion such as the gullwing at the right and left edges of the screen can be easily achieved. This is because the fifth-order pincushion distortion, which generates gullwing, emerges at the wires at the screen side cone portion of the vertical deflection coil which is wound in the winding angle range from 1° to 18° with the vertical axis as the standard. By comparatively reducing the winding distribution at the winding angle of from 1° to 18° , the fifth-order pincushion distortion can be decreased to curb the generation of the gullwing.

In the above mentioned preferable embodiment of the first aspect of color cathode ray tubes of the present invention in which the head point in the direction of screen side tube axis of the screen side cone portion of the vertical deflection coil is located in the range of from 10 mm to 60 mm away from the screen side tip portion of the core, since the gullwing can be effectively reduced as mentioned above, the image quality of the color cathode ray tube can be improved.

Since the above mentioned second aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil wherein the center of the screen side flange portion of one selected from the group consisting of the saddle shaped horizontal deflection coil comprises a projection toward the screen side, the screen side flange portion of one selected from the group consisting of the saddle shaped horizontal deflection coil and the saddle shaped vertical deflection coil is located closer to the screen side relative to the both side portions. As a result, when a fifth-order pincushion distortion is included in the distortion condition of the horizontal magnetic field distribution at the upper and lower regions and a local high order barrel shaped distortion is included at the upper and lower regions of the screen of the color cathode ray tube, the fifth-order barrel distortion is emphasized relatively at the upper and lower regions of the distortion condition of the horizontal magnetic field distribution to provide a good linear condition without having a high order upper and lower raster distortion. Further, since the screen side flange portion of the saddle shaped coil does not have an inflection point as in conventional arts, problems including the damage of the coil wires at the time of winding the horizontal deflection coil as well as the contact of the horizontal deflection coil, vertical deflection coil and ferrite core with each other in assembling the deflection yoke are avoided.

Since the above mentioned third aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a dent toward the electron gun side, the screen side flange portion of the saddle shaped coil is located closer to the electron gun side relative to the both side portions. As a result, when a fifth-order barrel distortion is included in the distortion condition of the horizontal magnetic field distribution at the upper and lower regions and a local high order pincushion shaped distortion is included at the upper and lower regions of the screen of the color cathode ray tube, the fifth-order pincushion distortion is emphasized relatively at the upper and lower regions of the distortion condition of the horizontal magnetic field distribution to provide a good linear condition without having a high order upper and lower raster distortion. Further, since the screen side flange portion of the saddle shaped coil does not have an inflection point as in conventional arts, problems including the damage to the coil wires at the time of winding the horizontal deflection coil as well as the contact of the horizontal deflection coil the vertical deflection coil and ferrite core in assembling the deflection yoke are avoided.

In the preferable embodiment of the above mentioned second or third aspect of deflection yokes of the present invention in which the surface of the screen side flange portion of the saddle shaped coil opposing a glass funnel of a color cathode ray tube is formed to have the contour conforming to the surface of the opposing glass funnel, since the screen side flange portion of one selected from the group consisting of the saddle shaped horizontal deflection coil and the saddle shaped vertical deflection coil is located closer to the electron beam, the correction sensitivity and the energy loss of the raster distortion at the screen side flange portion of the saddle shaped coil become maximum and minimum, respectively.

Since the above mentioned second aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil wherein the center of the screen side flange portion of one selected from the group consisting of the saddle shaped horizontal deflection coil and the saddle shaped vertical deflection coil comprises a projection toward the screen side, the following advantages can be achieved. That is, since the above mentioned deflection yoke of the third aspect of the present invention is used, as mentioned above, a fifth-order pincushion distortion is included in the distortion condition of the horizontal magnetic field distribution at the upper and lower regions, and when a high order local barrel shaped distortion is included at the upper and lower regions of the screen of the color cathode ray tube, the fifth-order barrel distortion is emphasized relatively at the upper and lower regions of the distortion condition of the horizontal magnetic field distribution. As a result, since the upper and lower raster distortion becomes preferably linear without a high order distortion, the image quality of the color cathode ray tube becomes improved.

Since the above mentioned third aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil, wherein the center of the screen side flange portion of one selected from the group consisting of the saddle shaped horizontal deflection coil and the saddle shaped vertical deflection coil comprises a dent toward the electron gun side, the following advantages can be achieved. That is, since the above mentioned deflection yoke of the fourth aspect of the present invention is used, as mentioned above, a fifth-order barrel distortion is included in the distortion condition of the horizontal magnetic field distribution at the upper and lower regions, and when a high order local pincushion shaped distortion is included at the upper and lower regions of the screen of the color cathode ray tube, the fifth-order pincushion distortion is emphasized relatively at the upper and lower regions of the distortion condition of the horizontal magnetic field distribution. As a result, since the upper and lower raster distortion becomes preferably linear without a high order distortion, the image quality of the color cathode ray tube becomes improved.

Since the above mentioned fourth aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil wherein the screen side flange portion of one selected from the group consisting of the saddle shaped horizontal deflection coil and the saddle shaped vertical deflection coil has a smoothly curved contour and the ratio r=c/d (c: the maximum width, d: the maximum height) is set in the range of from 2.2 to 3.5, corner portions of the screen side flange portion of the saddle shaped coil can be located farther from the glass funnel of the cathode ray tube to sufficiently reduce the strength of the magnetic field generated in the vicinity of the corner portions of the screen side flange portion of the saddle shaped coil to the tube axis direction. As a result, since the Lorentz's force applied on the electron beam becomes smaller when the electron beam is deflected on the screen corner portions of the color cathode ray tube, a high order raster distortion at the screen corner portion becomes reduced. Since the screen side flange portion of the saddle shaped coil need not be formed with a dent or a trapezoidal shape unlike conventional arts, the coil wires of the screen side flange portion are not damaged at the time of winding the horizontal deflection coil, or contact of the dent and the glass funnel portion of the cathode ray tube at the time of attaching the deflection yoke to the cathode ray tube can be avoided.

Since the above mentioned fourth aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil wherein the screen side flange portion of one selected from the group consisting of the saddle shaped horizontal deflection coil and the saddle shaped vertical deflection coil has a smoothly curved contour and the ratio r=c/d (c: the maximum width, d: the maximum height) is set in the range of from 2.2 to 3.5, the following advantages can be achieved. That is, since the above mentioned deflection yoke of the fifth aspect of the present invention is used, as mentioned above, a high order raster distortion at the screen corners can be reduced, and thus the image quality of the color cathode ray tube can be improved.

Since the above mentioned fifth aspect of deflection yokes of the present invention comprises at least a saddle shaped horizontal deflection coil, a saddle shaped vertical deflection coil located outside the saddle shaped horizontal deflection coil and a core located outside the saddle shaped vertical deflection coil wherein a gap is formed through the screen side flange portion of the horizontal deflection coil in the upper and lower direction and the coil wires are not located in the gap, the strength of the magnetic field generated in the vicinity of corner portions of the screen side flange portion of the horizontal deflection coil to the tube axis direction can be reduced. As a result, since the Lorentz's force applied on the electron beam becomes smaller when the electron beam is deflected on the screen corner portions of the color cathode ray tube, a high order raster distortion at the screen corner portion becomes reduced. Since the screen side flange portion of the saddle shaped coil need not be formed with a dent or a trapezoidal shape unlike conventional arts, the coil wires of the screen side flange portion are not damaged at the time of winding the horizontal deflection coil, and contact of the dent and the glass funnel portion of the cathode ray tube at the time of attaching the deflection yoke to the cathode ray tube can be avoided.

Since the above mentioned fifth aspect of color cathode ray tubes of the present invention comprises a color cathode ray tube main body comprising a glass panel portion and a glass funnel portion connected to the rear part of the glass panel portion, and a deflection yoke comprising at least an electron gun located at the rear of the cathode ray tube main body, a saddle shaped horizontal deflection coil located at the rear periphery of the cathode ray tube main body, a saddle shaped vertical deflection coil located outside the saddle shaped horizontal deflection coil and a core located outside the saddle shaped vertical deflection coil wherein a gap is formed through the screen side flange portion of the horizontal deflection coil to the upper and lower orientation, the following advantages can be achieved. That is, since the above mentioned deflection yoke of the sixth aspect of the present invention is used and a high order upper and lower raster distortion of the screen is reduced as mentioned above, the image quality of the color cathode ray tube can be improved.

DETAILED DESCRIPTION OF THE INVENTION

The present invention will be further described with reference to Examples.

EXAMPLE 1

Figure 1:
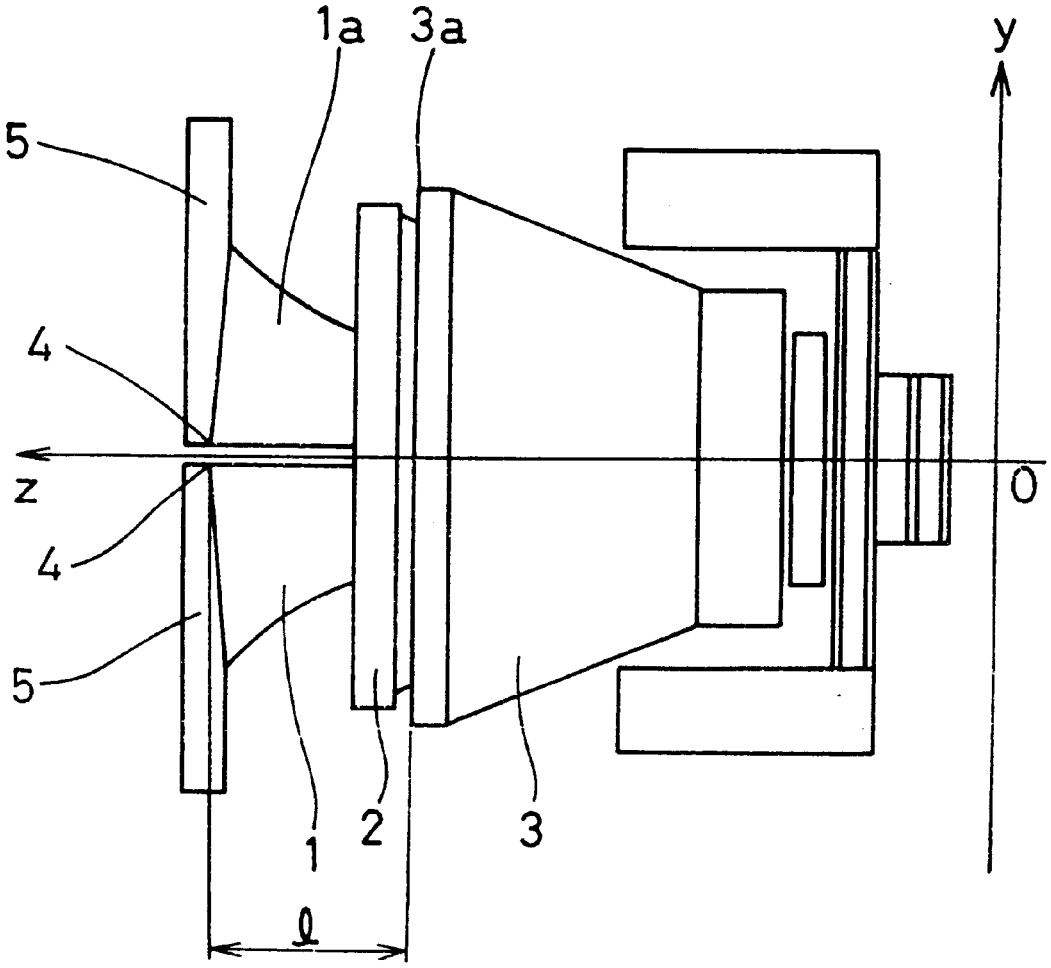
FIG. 1 is a side view of Example 1 of a deflection yoke of the present invention.
Figure 2:
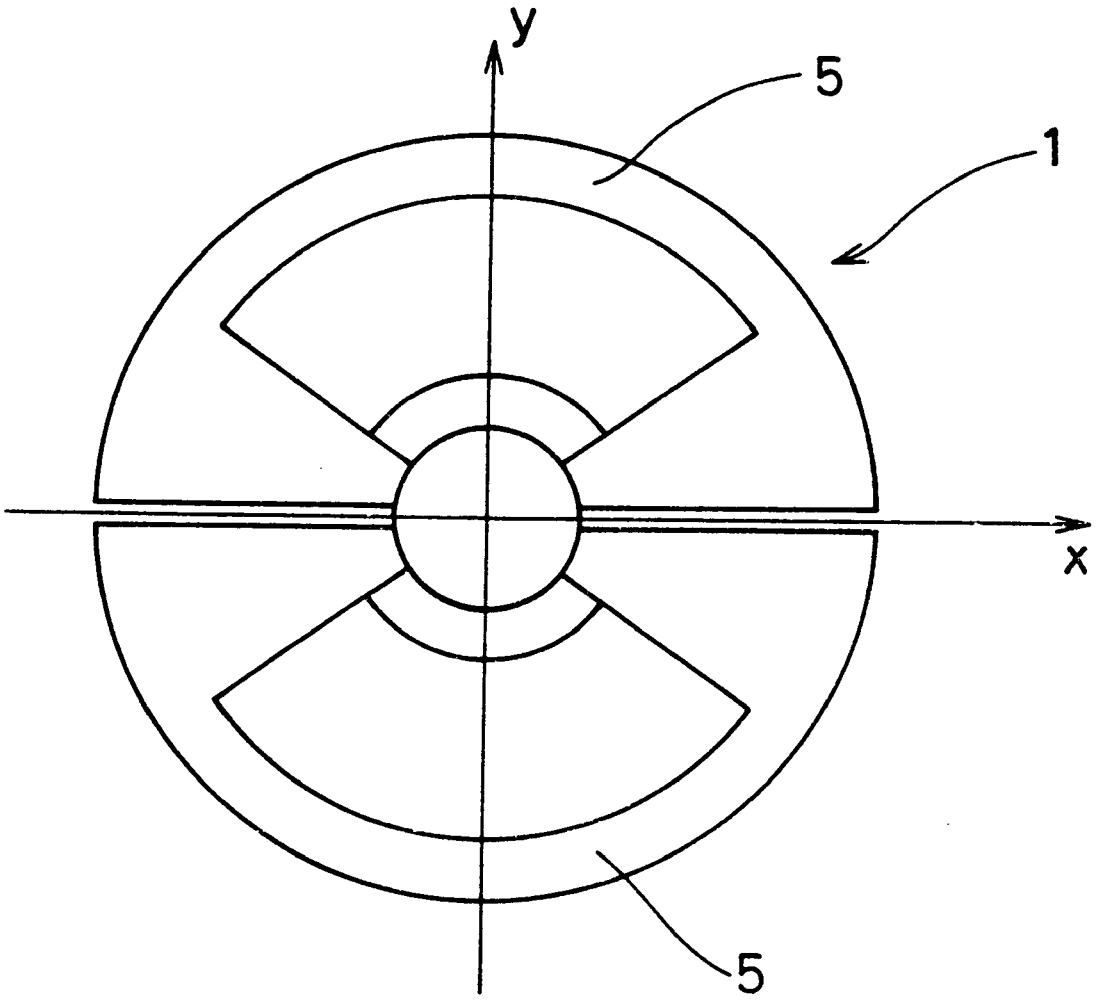
FIG. 2 is a diagram of the deflection yoke of FIG. 1 viewed from the screen side.

FIG. 1 is a side view illustrating the first Example of deflection yokes of the present invention and FIG. 2 is a diagram of the deflection yoke of FIG. 1 viewed from the screen side. As described in FIG. 1, the deflection yoke comprises a saddle shaped horizontal deflection coil 1, a saddle shaped vertical deflection coil 2 located outside the horizontal deflection coil 1, and a ferrite core 3 located outside the vertical deflection coil 2.

The screen side cone portion la of the horizontal deflection coil is wound in the winding angle range from 1° to 80° with a higher density of winding distribution in the winding angle range from 18° to 30° with the horizontal axis as the standard. The "winding angle" here is the term to describe the area occupied by the wound deflection coil viewed from the screen side by the angle with respect to the horizontal axis (X axis). The head point in the direction of screen side tube axis 4 is located 30 mm away from the screen side edge portion 3*a* of the ferrite core 3. Further, the screen side flange portion 5 is formed from the head point in the direction of screen side tube axis 4 of the screen side cone portion 1*a* of the horizontal deflection coil 1 continuously. As described in FIG. 2, the screen side flange portion 5 of the horizontal deflection coil 1 is wound approximately in a circular shape.

Figure 3:
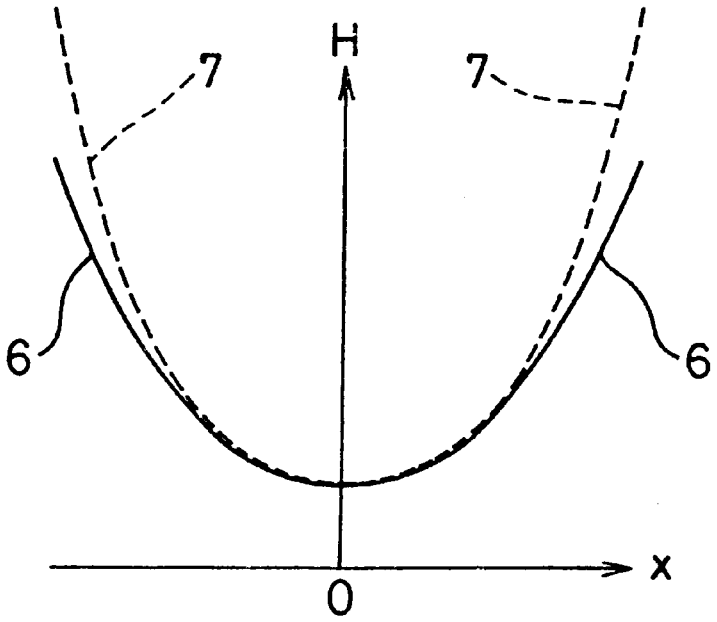
FIG. 3 is a graph illustrating the distortion condition of the horizontal magnetic field distribution to minimize the gullwing and the horizontal magnetic field distribution to generate the gullwing in Example 1 of the present invention.

The gullwing, which is a high order raster distortion at the upper and lower edges of the screen, arises from the distortion of the horizontal magnetic field distribution in the vicinity of the screen side aperture of the deflection yoke. The horizontal magnetic field distribution condition of the deflection yokes of the present invention is set as described by the solid line 6 in FIG. 3 to minimize the gullwing, and the distortion of the horizontal magnetic field distribution generated by the gullwing is as described by the broken line 7 of FIG. 3. That is, the horizontal magnetic field distribution described by the broken line 7 includes the fifth-order pincushion distortion. The fifth-order pincushion distortion is generated by the wires of the screen side cone portion 1*a* of the horizontal deflection coil 1 wound in the winding angle range from 1° to 18° with the horizontal axis as the standard. Screen side cone portion 1*a* of the horizontal deflection coil 1 of this Example has been appropriately adjusted in advance to have a relatively sparse winding distribution in the range of the winding angle from 1° to less than 18° and a relatively dense winding distribution in the range from 18° to 30°. By this procedure, since the fifth-order pincushion distortion is reduced, the condition of the horizontal magnetic field distribution to minimize the gullwing as described by the solid line 6 in FIG. 3 can be achieved.

Figure 4:
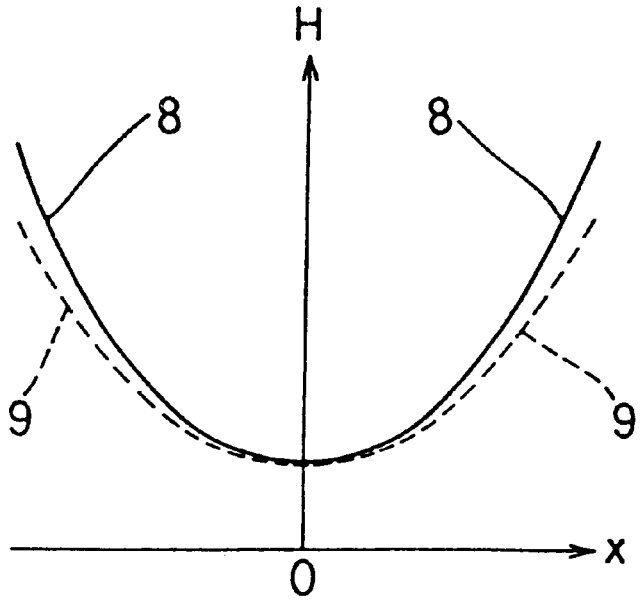
FIG. 4 is a graph illustrating the condition of the horizontal magnetic field distribution without the ferrite core effect on the field distribution and the condition of the horizontal magnetic field distribution with the ferrite core effect on the field distribution in Example 1 of the present invention.

However, if the ferrite core 3 is provided to the screen side cone portion 1*a* of the horizontal deflection coil 1 which has been adjusted with respect to the distortion condition of the horizontal magnetic field distribution accordingly, since the ferrite core effect on the field distribution of the ferrite core 3 alleviates the distortion condition of the horizontal magnetic field distribution, the optimum distortion condition of the horizontal magnetic field distribution to minimize the gullwing as described by the solid line 8 in FIG. 4 changes to the condition described by the broken line 9 in FIG. 4. As a consequence, the gullwing can not be corrected appropriately. Since the ferrite core effect on the field distribution of the ferrite core 3 deteriorates the deflection aberration correction sensitivity by the horizontal magnetic field distribution, when the distortion condition of the horizontal magnetic field distribution needs to be measured precisely, it should be measured without the presence of the ferrite core 3.

Figure 5:
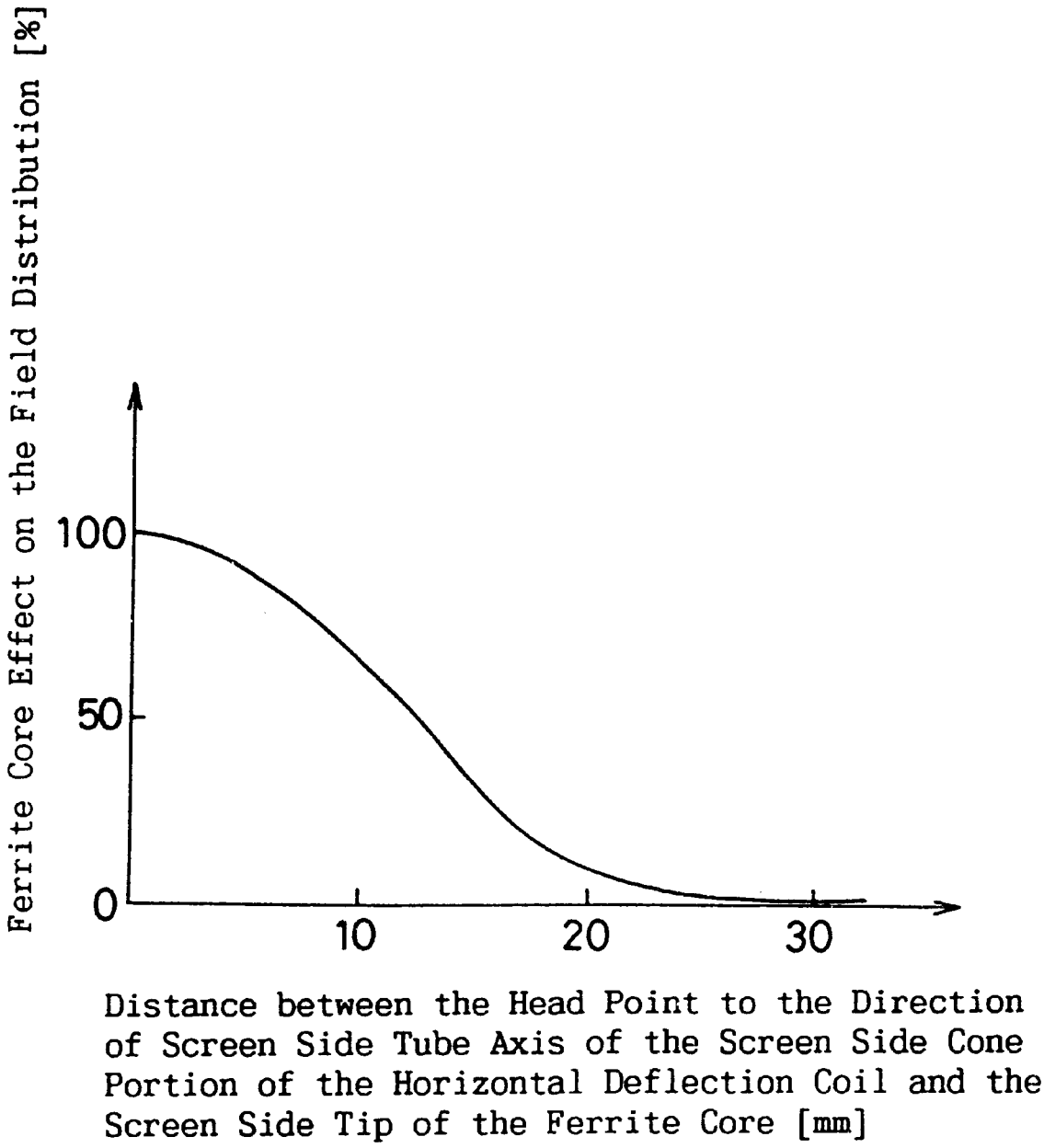
FIG. 5 is a graph illustrating the relationship of the ferrite core effect on the field distribution, and the distance between the head point in the direction of screen side tube axis at the horizontal saddle coil screen side cone portion and the ferrite core screen side tip in Example 1 of the present invention.

FIG. 5 is a graph illustrating the relationship between the ferrite core effect on the field distribution of the ferrite core, and the distance between the head point to the direction of screen side tube axis of the screen side cone portion of the horizontal deflection coil and the screen side edge portion of the ferrite core. As can be seen from the FIG. 5, when the distance between the head point in the direction of screen side tube axis 4 of the screen side cone portion 1*a* of the horizontal deflection coil 1 and the screen side edge portion 3*a* of the ferrite core 3*l* is 20 mm or more, the ferrite core effect on the field distribution is attenuated to less than 10%. From this observation, the distance between the head point to the direction of screen side tube axis 4 of the screen side cone portion 1*a* of the horizontal deflection coil 1 and the screen side edge portion 3*a* of the ferrite core 3*l* is set to be 30 mm in this Example. By this, since the ferrite core effect on the field distribution of the ferrite core 3 to the screen side cone portion 1*a* of the horizontal deflection coil 1 becomes smaller, the optimum distortion condition of the horizontal magnetic field distribution to minimize the gullwing as described by the solid line 8 in FIG. 4 can be achieved.

As mentioned above, if the screen side cone portion 1*a* of the horizontal deflection coil 1 is wound with the winding angle in the range of from 1° to 80° with a higher density of winding distribution in the range of the winding angle from 18° to 30° with the horizontal axis as the standard, and the head point in the direction of screen side tube axis 4 of the screen side cone portion 1*a* of the horizontal deflection coil 1 is located 30 mm away from the screen side edge portion 3*a* of the ferrite core 3, the gullwing can be effectively reduced. As a result since the screen side flange portion 5 of the horizontal deflection coil can be formed in approximately a circular shape as mentioned above unlike conventional arts, namely, without the need to be formed with a dent shape in the screen side flange portion 5 of the horizontal deflection coil 1 or having a polygon shaped screen side flange portion 5 of the horizontal deflection coil, problems such as the damage of the coil wires of the screen side flange portion 5 at the time of winding the horizontal deflection coil 1 in production can be avoided.

Although the screen side cone portion 1*a* of the horizontal deflection coil 1 is wound in the winding angle range of from 1° to 80° with a higher density of winding distribution in the winding angle range from 18° to 30° with the horizontal axis as the standard in this Example, the structures are not limited thereto and the range of winding angles is not specifically limited as long as the distortion condition of the horizontal magnetic field distribution to minimize the gullwing can be achieved.

Besides, although the head point in the direction of screen side tube axis 4 of the screen side cone portion 1*a* of the horizontal deflection coil 1 is located 30 mm away from the screen side edge portion 3*a* of the ferrite core 3 in this Example, the position of the head point to the direction of screen side tube axis 4 of the screen side cone portion 1*a* of the horizontal deflection coil 1 is not limited thereto and the same effect can be achieved if it is located in the range of from 20 mm to 60 mm away from the screen side edge portion 3*a* of the ferrite core 3. If the head point in the direction of screen side tube axis 4 of the screen side cone portion 1*a* of the horizontal deflection coil 1 is located more than 60 mm away from the screen side edge portion 3*a* of the ferrite core 3, the total length and the diameter of the coil become very large, and thus it is unpractical.

EXAMPLE 2

Figure 6:
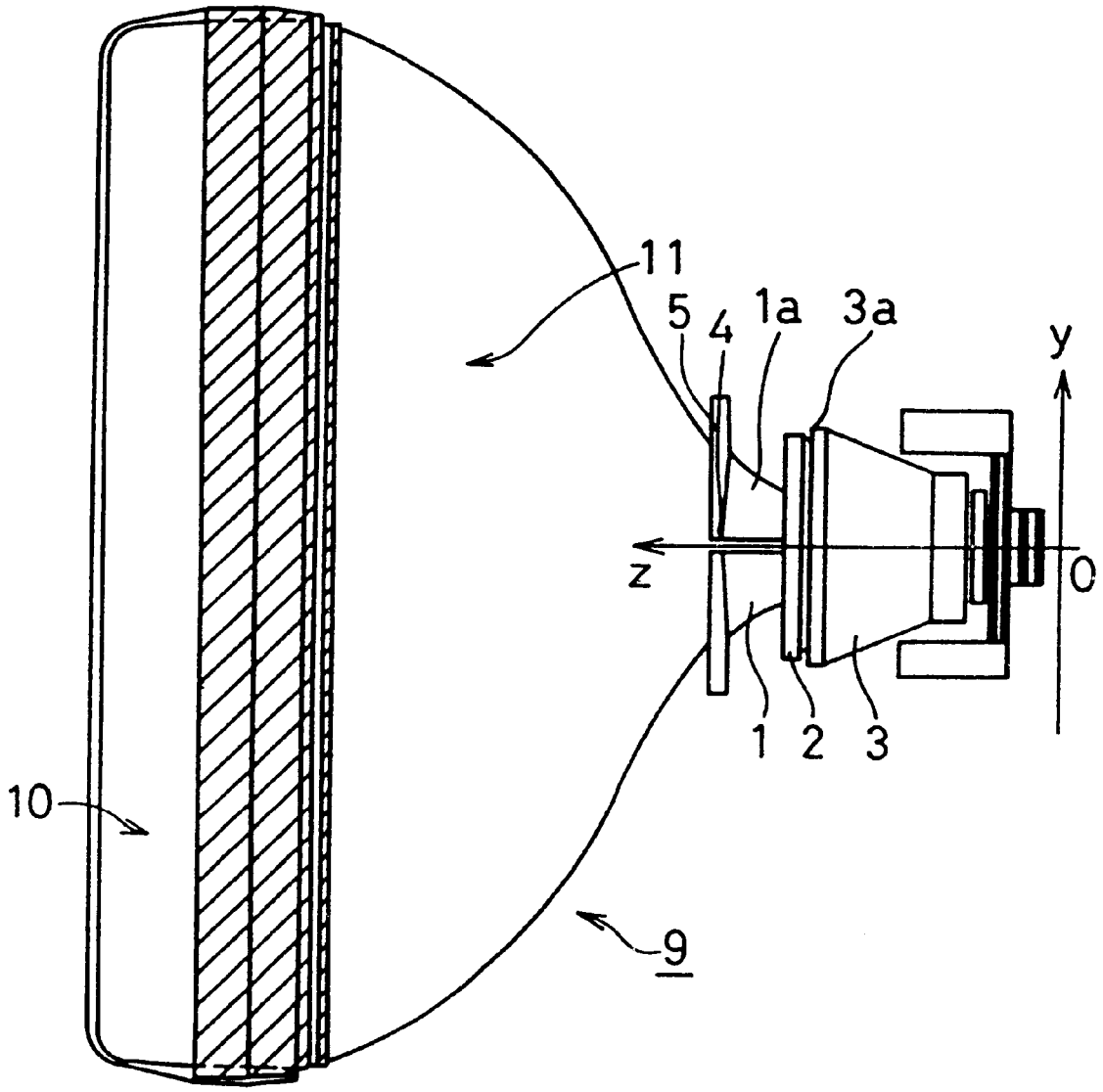
FIG. 6 is a plan view of a color cathode ray tube of Example 2 of the present invention

FIG. 6 is a plan view illustrating the second Example of color cathode ray tubes of the present invention. As can be seen in FIG. 6, the color cathode ray tube main body 9 comprises the glass panel portion 10, and the glass funnel portion 11 connected to the rear part of the glass panel portion 10. An electron gun (not shown in FIG. 6) is provided behind the glass funnel portion 11. The deflection yoke, comprising the saddle shaped horizontal deflection coil 1, the saddle shaped vertical deflection coil 2 located outside the horizontal deflection coil 1 and the ferrite core 3 located outside the vertical deflection coil 2, is located in the rear periphery of the glass funnel portion 11. The screen side cone portion 1*a* of the horizontal deflection coil 1 is wound in the winding angle range from 1° to 80° with a higher density of winding distribution in the range from 18° to 30° with the horizontal axis as the standard. The head point in the direction of screen side tube axis 4 of the screen side cone portion 1*a* of the horizontal deflection coil 1 is located 30 mm away from the screen side edge portion 3*a* of the ferrite core 3. Further, the screen side flange portion 5 is formed from the head point in the direction of screen side tube axis 4 of the screen side cone portion 1*a* of the horizontal deflection coil 1 continuously. The screen side flange portion 5 of the horizontal deflection coil 1 is wound approximately in a circular shape. That is, the deflection yoke described in the above mentioned Example a is comprised in the color cathode ray tube of the present Example (see FIG. 1 and FIG. 2). Since the deflection yoke with the structure described in the above mentioned Example 1 is used and the optimum distortion condition of the horizontal magnetic field distribution to minimize a high order raster distortion (gullwing) at the upper and lower edges of the screen can be easily achieved, the image quality of the color cathode ray tube can be improved.

Although the screen side cone portion 1*a* of the horizontal deflection coil 1 is wound in the winding angle range from 1° to 80° with a higher density of winding distribution in the range from 18° to 30° with the horizontal axis as the standard in this Example, the structures are not limited thereto and the range of winding angles is not specifically limited as long as the distortion condition of the horizontal magnetic field distribution to minimize the gullwing can be achieved.

Besides, although the head point in the direction of screen side tube axis 4 of the screen side cone portion 1*a* of the horizontal deflection coil 1 is located 30 mm away from the screen side edge portion 3*a* of the ferrite core 3 in this Example, the position of the head point in the direction of screen side tube axis 4 of the screen side cone portion 1*a* of the horizontal deflection coil 1 is not limited thereto and the same effect can be achieved if it is located in the range of from 20 mm to 60 mm away from the screen side edge portion 3*a* of the ferrite core 3. If the head point to the direction of screen side tube axis 4 of the screen side cone portion 1*a* of the horizontal deflection coil 1 is located more than 60 mm away from the screen side edge portion 3*a* of the ferrite core 3, the total length and the diameter of the coil become very large, and thus it is unpractical.

EXAMPLE 3

Figure 7:
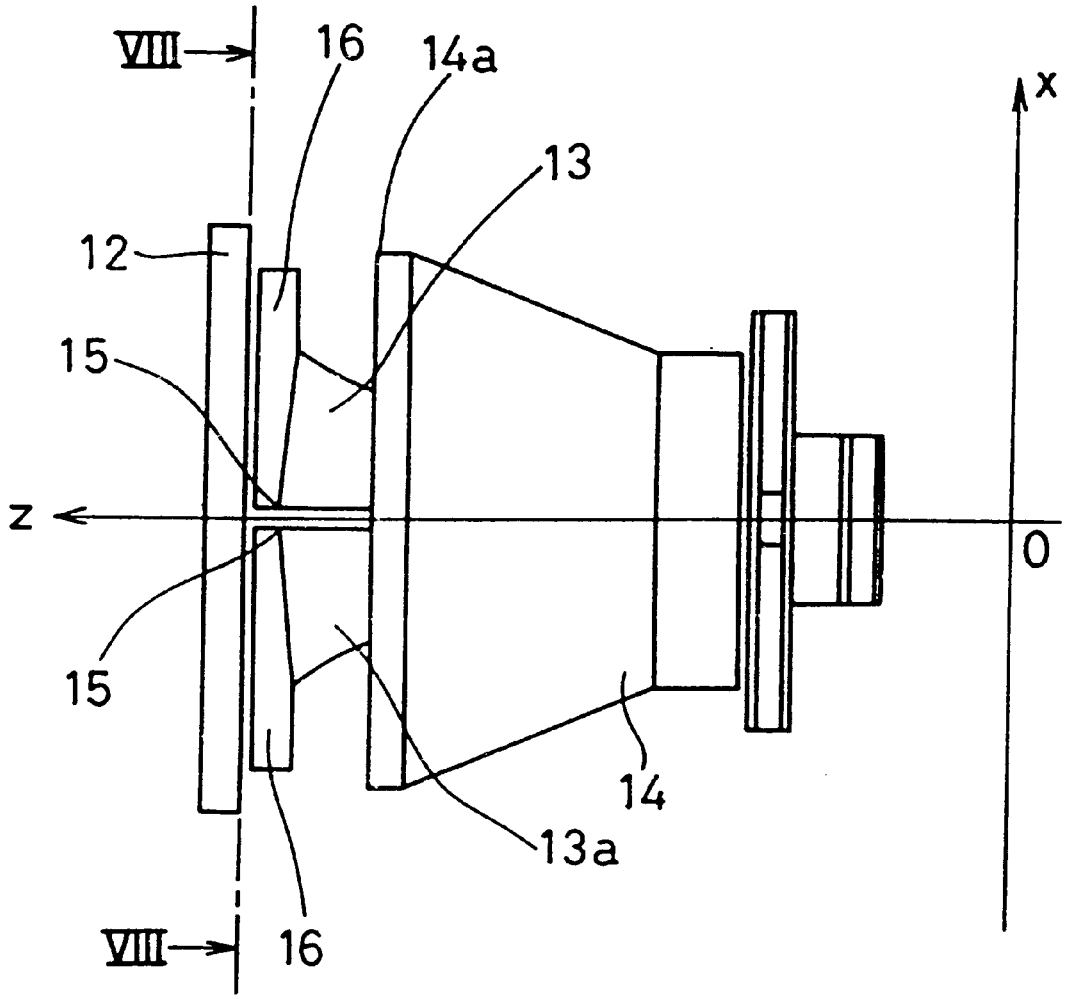
FIG. 7 is a plan view of a deflection yoke of Example 3 of the present invention.

FIG. 7 is a plan view illustrating the third Example of deflection yokes of the present invention. As can be seen in FIG. 7, the deflection yoke comprises the saddle shaped wound horizontal deflection coil 12, the saddle shaped vertical deflection coil 13 located outside the horizontal deflection coil 12, and the ferrite core 14 located outside the vertical deflection coil 13.

Figure 8:
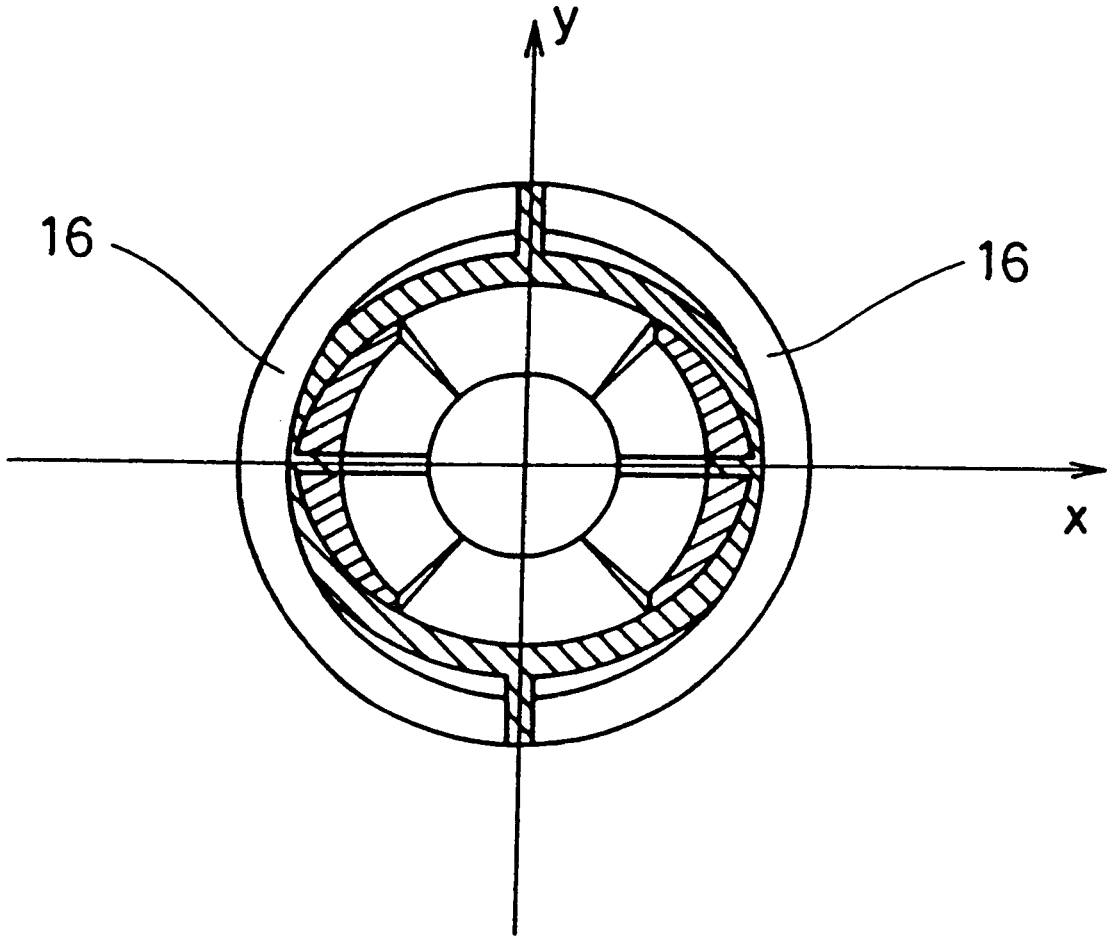
FIG. 8 is a section view taken along the line VIII—VIII of FIG. 7.

The screen side cone portion 13*a* of the vertical deflection coil 13 is wound in the winding angle range from 1° to 80° with a higher density of winding distribution in the range from 18° to 30° with the vertical axis as the standard. The head point in the direction of screen side tube axis 15 is located 20 mm away from the screen side edge portion 14*a* of the ferrite core 14. Further, the screen side flange portion 16 is formed from the head point in the direction of screen side tube axis 15 of the screen side cone portion 13*a* of the vertical deflection coil 13 continuously. As described in FIG. 8, the screen side flange portion 16 of the vertical deflection coil 13 is wound approximately in a circular shape.

Figure 9:
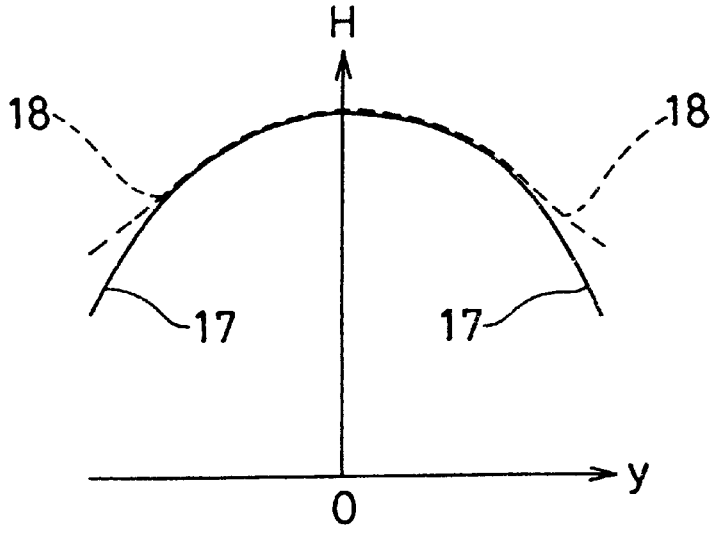
FIG. 9 is a graph illustrating the distortion condition of the horizontal magnetic field distribution to minimize the gulelwing and the condition of the horizontal magnetic field distribution to generate the gullwing in Example 3 of the present invention.

The gullwing at the right and left rasters arises from the distortion of the vertical magnetic field distribution in the vicinity of the screen side aperture of the deflection yoke. The condition of the vertical magnetic field distribution of the deflection yokes of the present invention is set as described by the solid line 17 in FIG. 9 to minimize the gullwing, and the distortion of the vertical magnetic field distribution generated by the gullwing becomes as described by the broken line 18 of FIG. 9. That is, the vertical magnetic field distribution described by the broken line 18 includes the fifth-order pincushion distortion. The fifth-order pincushion distortion is generated by the wires of the screen side cone portion 13*a* of the vertical deflection coil 13 wound in the winding angle range from 1° to 18° with the vertical axis as the standard. Screen side cone portion 13*a* of the vertical deflection coil 13 of this Example has been appropriately adjusted in advance to have a relatively sparse winding distribution in the range of the winding angle from 1° to less than 18° and a relatively dense winding distribution in the range of the winding angle from 18° to 30°. By this procedure, since the fifth-order pincushion distortion is reduced, the condition of the vertical magnetic field distribution to minimize the gullwing (as described by the solid line 17 in FIG. 9) can be achieved.

Figure 10:
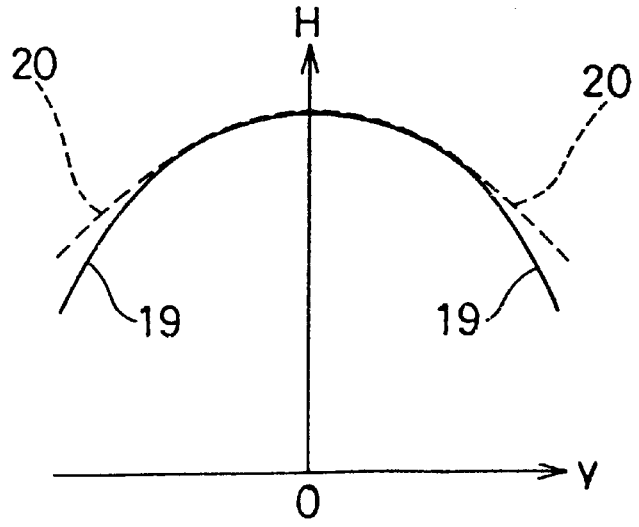
FIG. 10 is a graph illustrating the condition of the horizontal magnetic field distribution without the ferrite core effect on the field distribution and the condition of the horizontal magnetic field distribution with the ferrite core effect on the field distribution in Example 3 of the present invention.

However, if the ferrite core 14 is provided to the screen side cone portion 13*a* of the vertical deflection coil 13 which has been adjusted with respect to the distortion condition of the vertical magnetic field distribution accordingly, since the ferrite core effect on the field distribution of the ferrite core 14 alleviates the distortion condition of the vertical magnetic field distribution, the optimum distortion condition of the vertical magnetic field distribution to minimize the gullwing as described in the solid line 19 in FIG. 10 changes to the condition described by the broken line 20 in FIG. 10. As a consequence, the gullwing can not be corrected appropriately. Since the ferrite core effect on the field distribution of the ferrite core 14 deteriorates the deflection aberration correction sensitivity by the vertical magnetic field distribution, when the distortion condition of the vertical magnetic field distribution needs to be controlled precisely, it should be controlled without the presence of the ferrite core 14.

Figure 11:
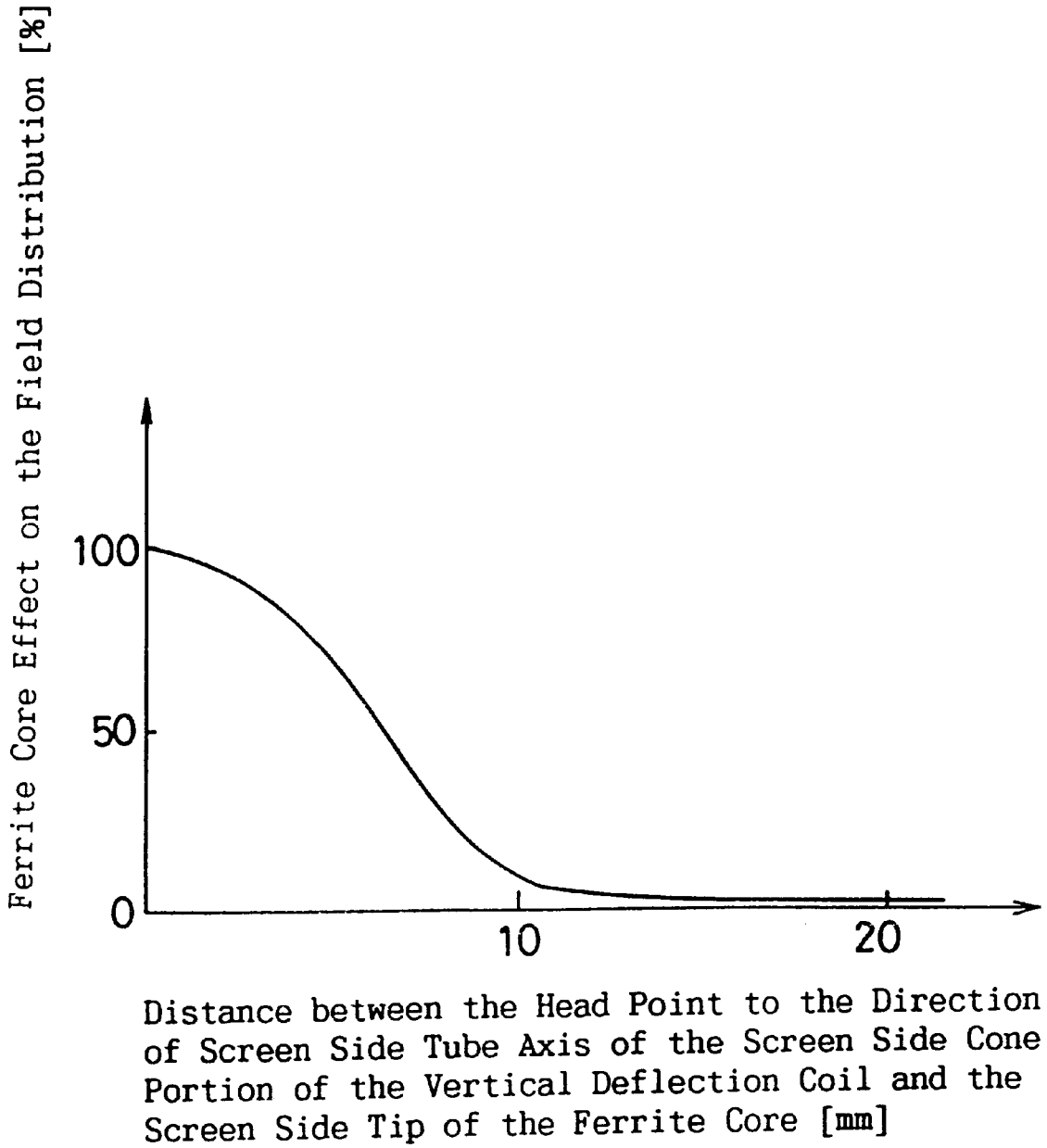
FIG. 11 is a graph illustrating the relationship of the ferrite core effect on the field distribution, and the distance between the head point in the direction of the screen side tube axis of the vertical deflection coil screen side cone portion and the ferrite core screen side tip in Example 3 of the present invention.

FIG. 11 is a graph illustrating the relationship between the ferrite core effect on the field distribution of the ferrite core, and the distance between the head point in the direction of screen side tube axis of the screen side cone portion of the vertical deflection coil and the screen side edge portion of the ferrite core. As can be seen from the FIG. 11, when the distance between the head point to the direction of screen side tube axis 15 of the screen side cone portion 13*a* of the vertical deflection coil 13 and the screen side edge portion 14*a* of the ferrite core 14 is 10 mm or more, the ferrite core effect on the field distribution is attenuated to less than 10%. From this observation, the distance between the head point to the direction of screen side tube axis 15 of the screen side cone portion 13*a* of the vertical deflection coil 13 and the screen side edge portion 14*a* of the ferrite core 14 is set to be 20 mm in this Example. By this, since the ferrite core effect on the field distribution of the ferrite core 14 to the screen side cone portion 13*a* of the vertical deflection coil 13 becomes smaller, the optimum distortion condition of the vertical magnetic field distribution to minimize the gullwing as described by the solid line 19 in FIG. 10 can be achieved.

As mentioned above, if the screen side cone portion 13*a* of the vertical deflection coil 13 is wound with the winding angle in the range of from 1° to 80° with a high density of winding distribution in the range of the winding angle from 18° to 30° with the vertical axis as the standard, and the head point in the direction of screen side tube axis 15 of the screen side cone portion 13*a* of the vertical deflection coil 13 is located 20 mm away from the screen side edge portion 14*a* of the ferrite core 14, the gullwing can be effectively reduced. As a result, since the screen side flange portion 16 of the vertical deflection coil 13 can be formed in approximately a circular shape as mentioned above, without the need to form a dent shape in the screen side flange portion 16 of the vertical deflection coil 13 or have a screen side flange portion 16 with a polygon shape of the vertical deflection coil 13, problems such as the damage in production to the coil wires of the screen side flange portion 16 at the time of winding the vertical deflection coil 13 can be avoided.

Although the screen side cone portion 13*a* of the vertical deflection coil 13 is wound in the winding angle range from 1° to 80° with a higher density of winding distribution in the range from 18° to 30° with the vertical axis as the standard in this Example, the structures are not limited thereto and the range of winding angles is not specifically limited as long as the distortion condition of the vertical magnetic field distribution to minimize the gullwing can be achieved.

Besides, although the head point in the direction of screen side tube axis 15 of the screen side cone portion 13*a* of the vertical deflection coil 13 is located 20 mm away from the screen side edge portion 14*a* of the ferrite core 14 in this Example, the position of the head point in the direction of screen side tube axis 15 of the screen side cone portion 13*a* of the vertical deflection coil 13 is not limited thereto and the same effect can be achieved if it is located in the range of from 10 mm to 60 mm away from the screen side edge portion 14*a* of the ferrite core 14. If the head point in the direction of screen side tube axis 15 of the screen side cone portion 13*a* of the vertical deflection coil 13 is located more than 60 mm away from the screen side edge portion 14*a* of the ferrite core 14, the total length and the diameter of the coil become very large, and thus it is unpractical.

EXAMPLE 4

Figure 12:
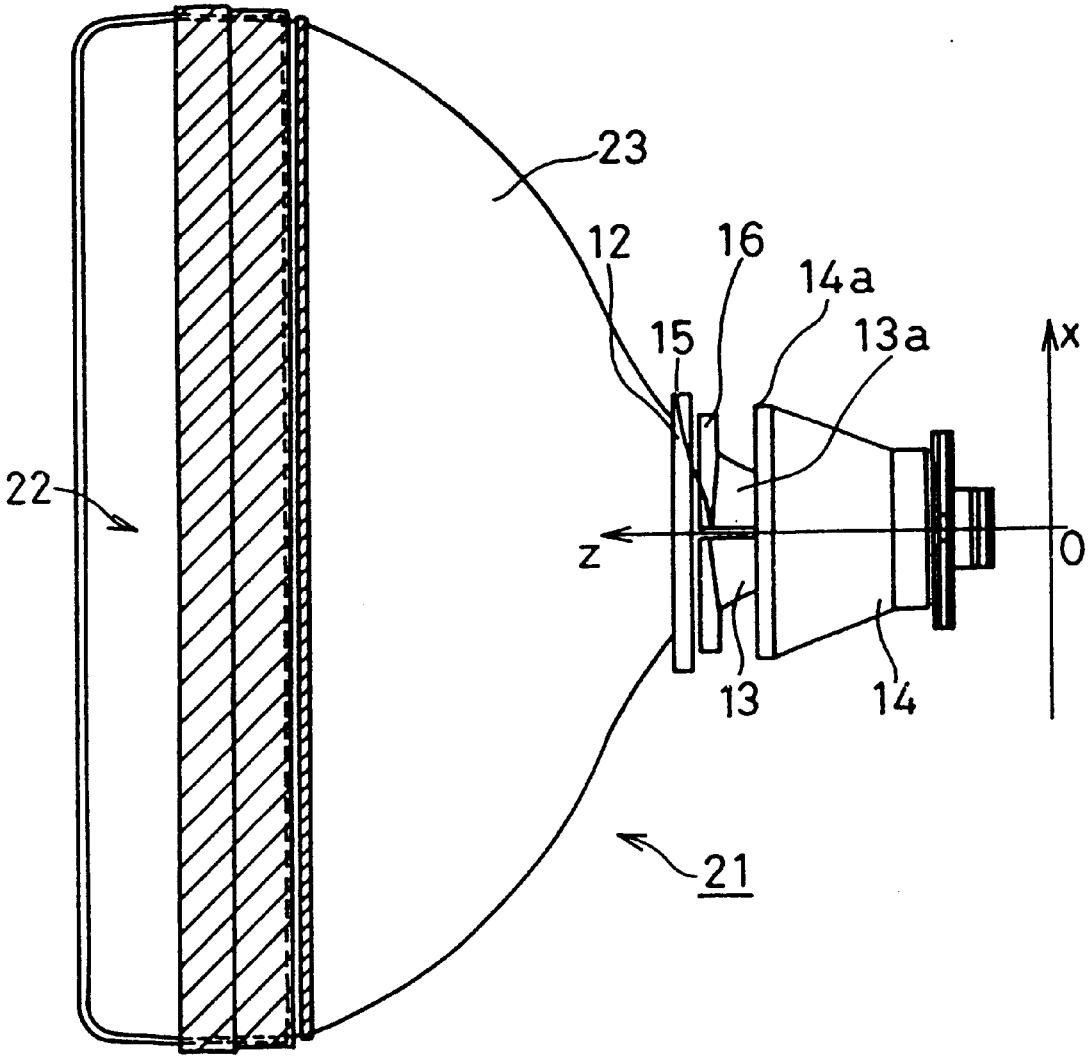
FIG. 12 is a plan view of a cathode ray tube of Example 4 of the present invention.

FIG. 12 is a plan view illustrating the fourth Example of color cathode ray tubes of the present invention. As can be seen in FIG. 12, the color cathode ray tube main body 21 comprises the glass panel portion 22, and glass funnel portion 23 connected to the rear part of the glass panel portion 22. An electron gun (not shown in FIG. 12) is provided behind the glass funnel portion 23. The deflection yoke, comprising the saddle shaped horizontal deflection coil 12, the saddle shaped vertical deflection coil 13 located outside the horizontal deflection coil 12 and the ferrite core 14 located outside the vertical deflection coil 13, is located in the rear periphery of the glass funnel portion 23. The screen side cone portion 13*a* of the vertical deflection coil 13 is wound in the winding angle range from 1° to 80° with a higher density of winding distribution in the range from 18° to 30° with the vertical axis standard. The head point in the direction of screen side tube axis 15 of the screen side cone portion 13*a* of the vertical deflection coil 13 is located 20 mm away from the screen side edge portion 14*a* of the ferrite core 14. Further, the screen side flange portion 16 is formed from the head point to the direction of screen side tube axis 15 of the screen side cone portion 13*a* of the vertical deflection coil 13 continuously. The screen side flange portion 16 of the vertical deflection coil 13 is wound approximately in a circular shape. That is, the deflection yoke described in the above mentioned Example 3 is used in the color cathode ray tube of the present Example (see FIG. 7, FIG. 8). Since the deflection yoke with the structure described in the above mentioned Example 3 is used, since the optimum distortion condition of the vertical magnetic field distribution to minimize a high order raster distortion (gullwing) at the right and left edges of the screen can be easily achieved, the image quality of the color cathode ray tube can be improved.

Although the screen side cone portion 13*a* of the vertical deflection coil 13 is wound in the winding angle range from 1° to 80° with a higher density of winding distribution in the range from 18° to 30° with the vertical axis as the standard in this Example, the structures are not limited thereto and the range of winding angles is not specifically limited as long as the distortion condition of the vertical magnetic field distribution to minimize the gullwing can be achieved.

Besides, although the head point in the direction of screen side tube axis 15 of the screen side cone portion 13*a* of the vertical deflection coil 13 is located 20 mm away from the screen side edge portion 14*a* of the ferrite core 14 in this Example, the position of the head point in the direction of screen side tube axis 15 of the screen side cone portion 13*a* of the vertical deflection coil 13 is not limited thereto and the same effect can be achieved if it is located in the range of from 10 mm to 60 mm away from the screen side edge portion 14*a* of the ferrite core 14. If the head point in the direction of screen side tube axis 15 of the screen side cone portion 13*a* of the vertical deflection coil 13 is located more than 60 mm away from the screen side edge portion 14*a* of the ferrite core 14, the total length and the diameter of the coil become very large, and thus it is unpractical.

In general, the magnetic field at the screen side of a deflection yoke is much more sensitive than the magnetic field at the electron gun side with respect to controlling the raster distortion. Therefore, methods such as controlling the raster distortion in the magnetic field generated by the screen side flange portion of the saddle shaped coil are highly effective.

Figure 21:
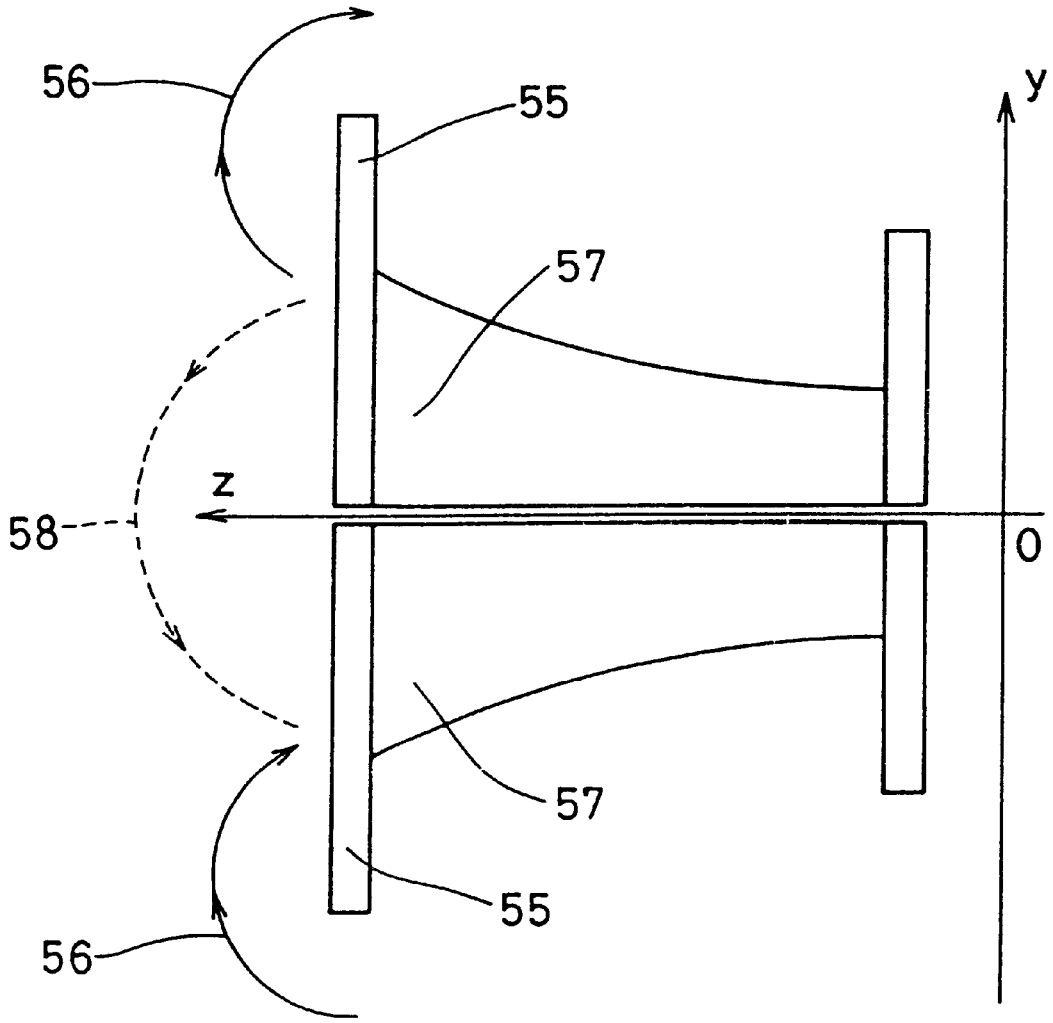
FIG. 21 is a diagram illustrating the magnetic field generated at the screen side flange portion and cone portion of the saddle shaped coil.

As described in FIG. 21, in a saddle shaped coil, the screen side magnetic field 56 generated by the screen side flange portion 55 is oriented in the direction to offset the magnetic field 58 generated by the cone portion 57, and the distortion of the magnetic field includes the fifth-order barrel distortion. The embodiments later described in detail in Examples 5 to 7 are achieved with attention to the magnetic field of the fifth-order barrel distortion generated by the screen side flange portion 55. That is, this is to control the fifth-order barrel distortion or pincushion distortion of the magnetic field at the screen side to allow sufficient reduction of the high order raster distortion by forming the screen side flange portion 55 of the saddle shaped coil to have a projection toward the screen side or a dent toward the electron gun. Further, with such structure, since the screen side flange portion 55 does not have an inflection point as in conventional arts, the coil wires of the screen side flange portion 55 are not damaged at the time of winding the saddle shaped coil, and the horizontal deflection coil, the vertical deflection coil and the ferrite core do not come in contact with each other at the time of assembling the deflection yoke.

EXAMPLE 5

Figure 13:
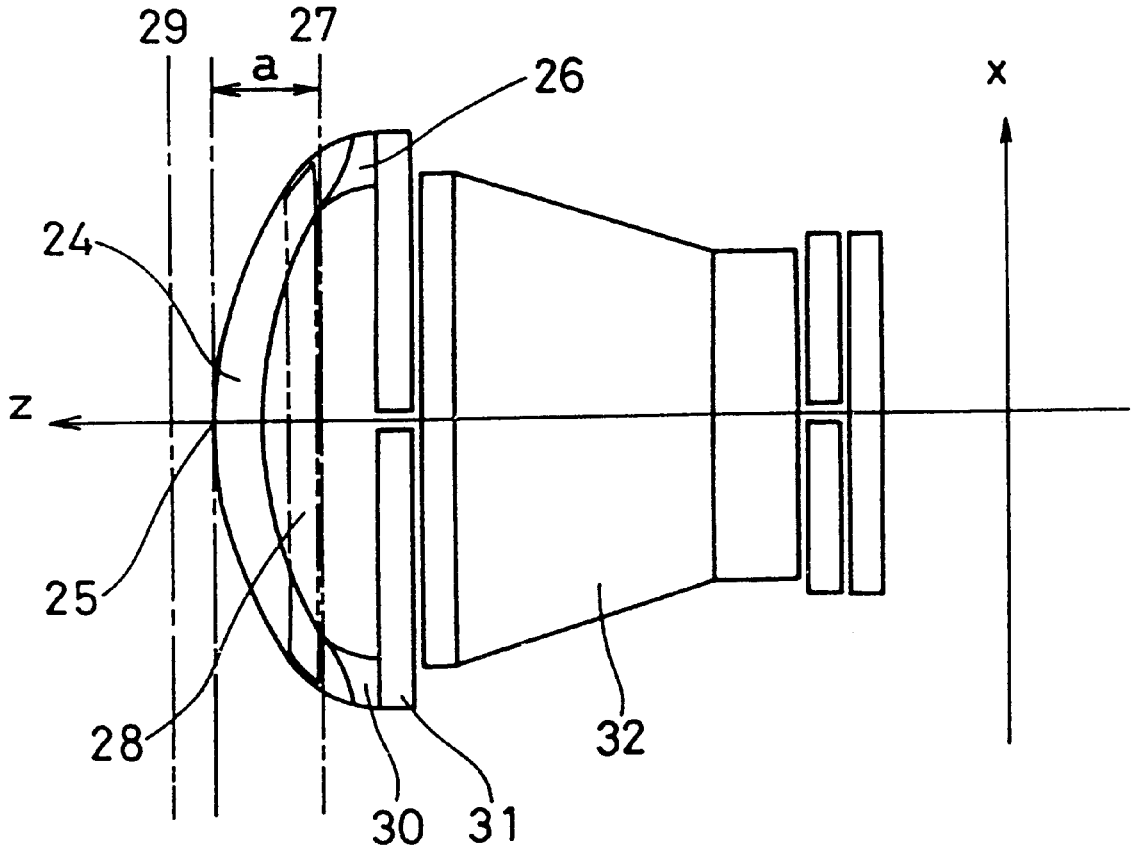
FIG. 13 is a plan view of a deflection yoke of Example 5 of the present invention.
Figure 14:
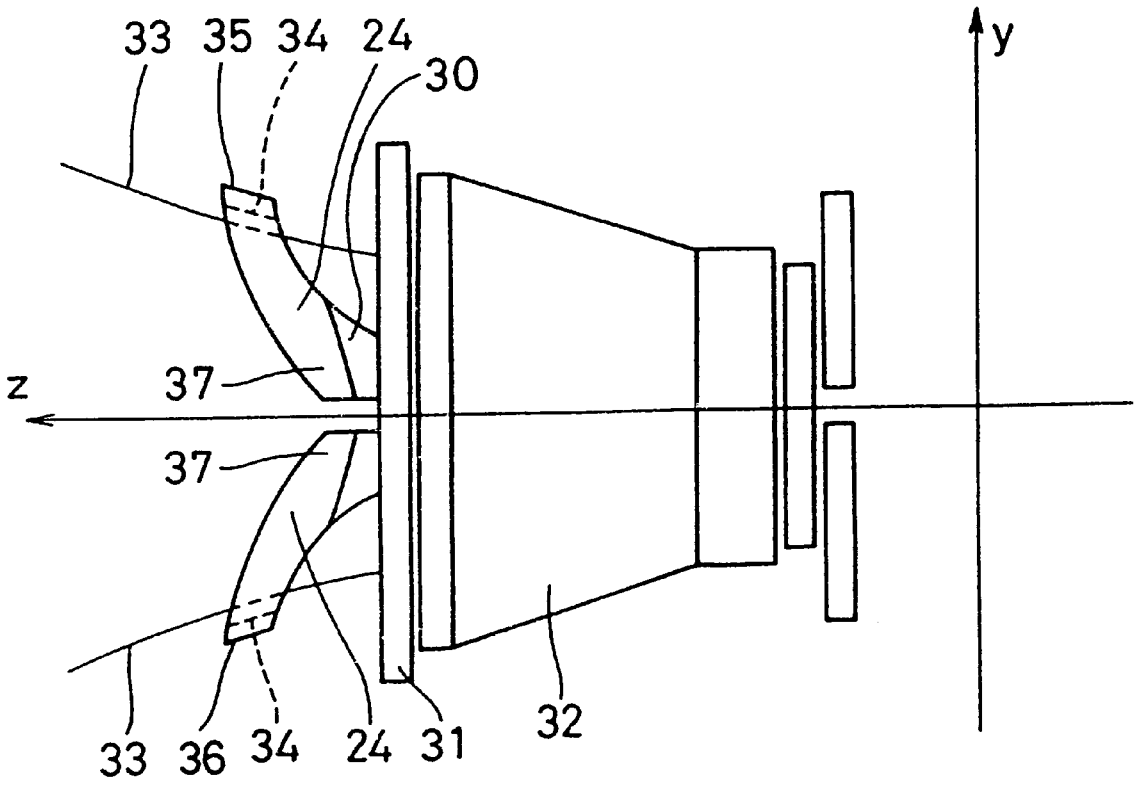
FIG. 14 is a side view of a deflection yoke of FIG. 13.

FIG. 13 is a plan view illustrating the fifth Example of deflection yokes of the present invention and FIG. 14 is a side view of the deflection yoke of FIG. 13. As can be seen in FIG. 13 and FIG. 14, the deflection yoke comprises the saddle shaped horizontal deflection coil 30, the saddle shaped vertical deflection coil 31 located outside the horizontal deflection coil 30, and the ferrite core 32 located outside the vertical deflection coil 31.

As described in FIG. 13, the screen side flange portion 24 of the horizontal deflection coil 30 is formed to have a projection toward the screen side with the top portion at the point crossing the tube axis (Z axis) 25. The projection size a is set to be 30 mm away from the maximum projection line 27 of the screen side cone portion 26.

As described in FIG. 14, the surface 34 of the screen side flange portion of the horizontal deflection coil 30 opposing the glass funnel portion of the color cathode ray tube 33 is formed to conform to the shape of the surface of the opposing glass funnel portion 33. By this, since the screen side flange portion 24 of the horizontal deflection coil 30 can be placed close to the electron beam, the correction sensitivity of the raster distortion and the energy loss at the screen side flange portion 24 of the horizontal deflection coil 30 become maximum and minimum, respectively.

FIG. 13 shows a plan view of the screen side flange portion 28 of a horizontal deflection coil with a conventional, approximately circular shape by the chain double-dashed line, which is a straight line. In this case, the condition of the horizontal magnetic field distribution at the cross section along the horizontal axis (X axis)—the vertical axis (Y axis) at a screen side position 29 is as illustrated by the solid line in FIG. 15, and the upper and lower raster distortion may generate local barrel shaped high order distortion 39*a*, 39*b* at the upper and lower portions of a color cathode ray tube as illustrated in FIG. 16. Such barrel shaped high order distortion 39*a*, 39*b* are generated because the condition of the horizontal magnetic field distortion of FIG. 15 includes the fifth-order pincushion distortion in the regions of the upper portion 38a and the lower portion 38*b*.

Figure 15:
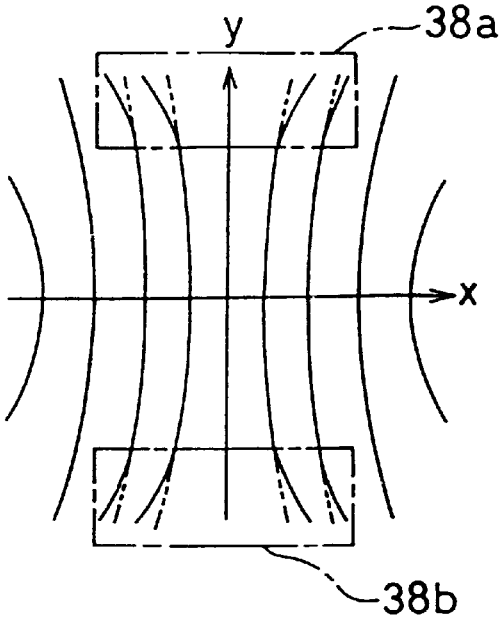
FIG. 15 is a diagram illustrating the deflection condition of the horizontal magnetic field distribution at the screen side of Example 5 of the present invention.
Figure 16:
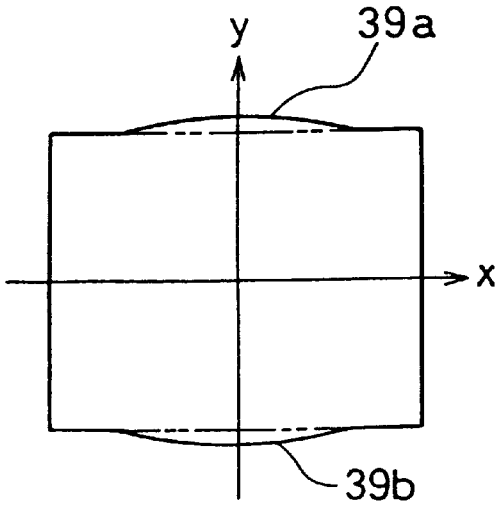
FIG. 16 is a diagram illustrating the upper and lower raster distortion of Example 5 of the present invention.

On the other hand, if the screen side flange portion 24 of the horizontal deflection coil 30 is formed to have a projection toward the screen side as in this Example, since the upper portion 35 and the lower portion 36 of the screen side flange portion 24 are closer to the screen side relative to the both side portions 37, the fifth-order barrel distortion is relatively emphasized in the regions of the upper portion 38*a* and the lower portion 38*b* of the distortion condition of the horizontal magnetic field distribution in FIG. 15 and the distortion condition of the horizontal magnetic field distribution becomes as the chain double-dashed line in FIG. 15. As a result, the upper and lower raster distortion is corrected to have a preferable linear shape without a high order distortion as illustrated by the chain double-dashed line in FIG. 16.

Further, since the deflection yoke of this Example does not have an inflection point at the screen side flange portion 24 of the horizontal deflection coil 30 unlike conventional arts, problems such as the damage in production to the coil wires at the time of winding the horizontal deflection coil 30 as well as the contact of the horizontal deflection coil 30, the vertical deflection coil 31 and the ferrite core 32 with each other at the time of assembling the deflection yoke can be prevented.

Although the screen side flange portion 24 of the horizontal deflection coil 30 is formed to have a projection with the projection size a of 30 mm away from the maximum projection line 27 of the screen side cone portion 26, the size is not limited thereto.

EXAMPLE 6

Figure 17:
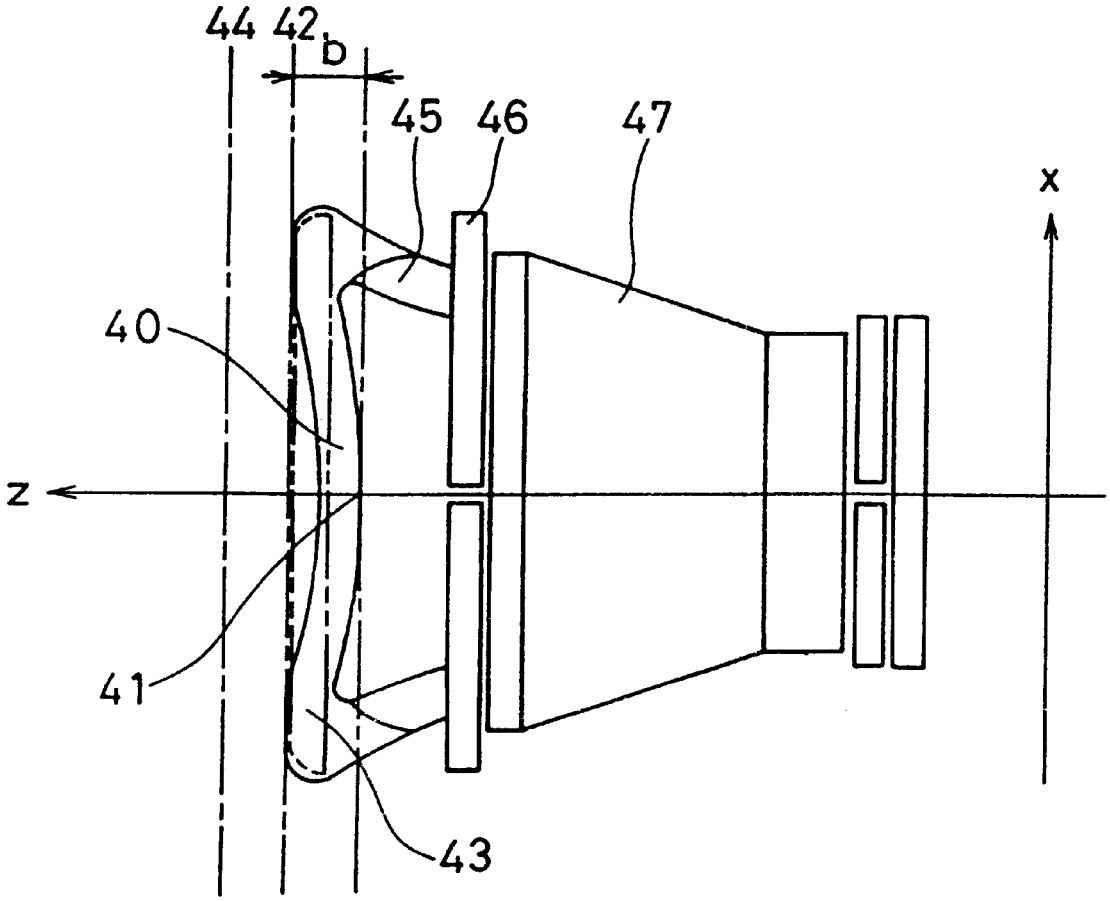
FIG. 17 is a plan view of a deflection yoke of Example 6 of the present invention.
Figure 18:
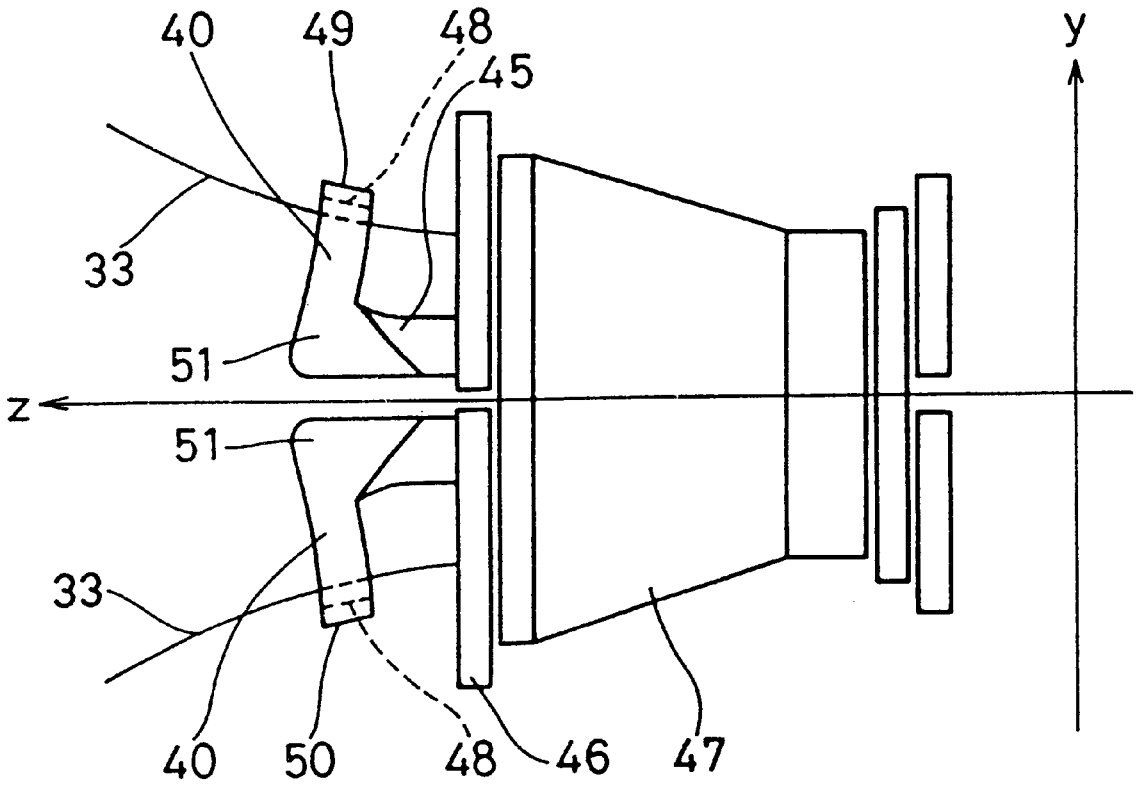
FIG. 18 is a side view of the deflection yoke of FIG. 17.

FIG. 17 is a plan view illustrating the sixth Example of deflection yokes of the present invention and FIG. 18 is a side view of the deflection yoke of FIG. 17. As can be seen in FIG. 17 and FIG. 18, the deflection yoke comprises the saddle shaped horizontal deflection coil 45, the saddle shaped vertical deflection coil 46 located outside the horizontal deflection coil 45, and the ferrite core 47 located outside the vertical deflection coil 46.

As described in FIG. 17, the screen side flange portion 40 of the horizontal deflection coil 45 is formed to have a dent toward the electron gun side with the bottom portion at the point crossing the tube axis (Z axis) 41. The dent size b is set to be 15 mm away from the maximum projection line 42 of the screen side flange portion 40.

As described in FIG. 18, the surface opposing the glass funnel portion of the color cathode ray tube 33 48 of the screen side flange portion of the horizontal deflection coil 45 is formed to have the shape conforming to the shape of the surface of the opposing glass funnel portion 33. By this, since the screen side flange portion 40 of the horizontal deflection coil 45 can be placed close to the electron beam, the correction sensitivity of the raster distortion and the energy loss at the screen side flange portion 40 of the horizontal deflection coil 45 become maximum and minimum, respectively.

FIG. 17 shows a plan view of the screen side flange portion 43 of a horizontal deflection coil 45 which has a conventional, approximately circular shape by a chain double-dashed line, which is a straight line. In this case, the condition of the horizontal magnetic field distribution at the cross section along the horizontal axis (X axis)—the vertical axis (Y axis) at a screen side position 44 is as illustrated by the solid line in FIG. 19, and the upper and lower raster distortion may generate local pincushion shaped high order distortion 54*a*, 54*b* at the upper and lower portions of a color cathode ray tube as illustrated in FIG. 20. Such pincushion shaped high order distortion 54*a*, 54*b* are generated because the condition of the horizontal magnetic field distortion of FIG. 19 includes the fifth-order barrel distortion in the regions of the upper portion 52*a* and the lower portion 52*b*.

Figure 19:
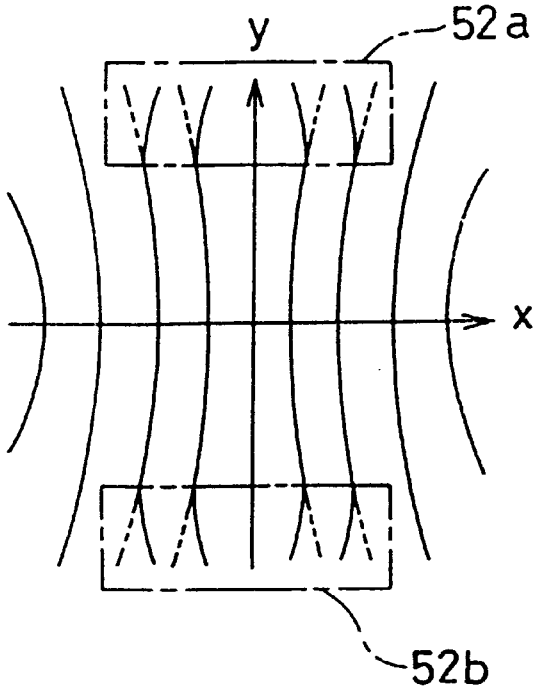
FIG. 19 is a diagram illustrating the distortion condition of the horizontal magnetic field distribution at the screen side of Example 6 of the present invention.
Figure 20:
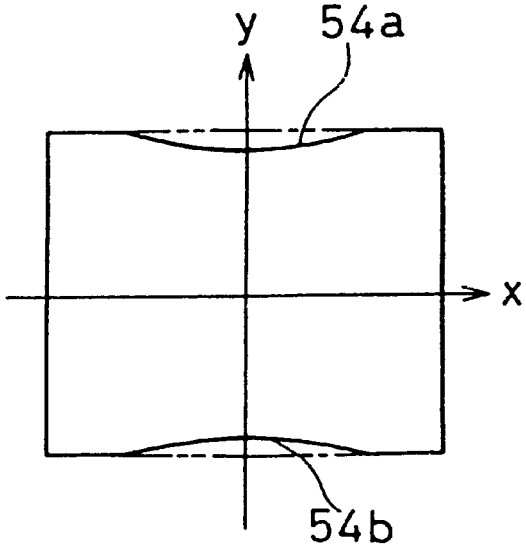
FIG. 20 is a diagram illustrating the upper and lower raster distortion of Example 6 of the present invention.

On the other hand, if the screen side flange portion 40 of the horizontal deflection coil 45 is formed to have a dent toward the screen side as in this Example, since the upper portion 49 and the lower portion 50 of the screen side flange portion 40 are closer to the electron gun relative to the both side portions 51, the fifth-order pincushion distortion is relatively emphasized in the regions of the upper portion 52*a* and the lower portion 52*b* of the distortion condition of the horizontal magnetic field distribution in FIG. 19 and the distortion condition of the horizontal magnetic field distribution becomes as the chain double-dashed line in FIG. 19. As a result, the upper and lower raster distortion is corrected to have a preferable linear without a high order distortion as illustrated by the chain double-dashed line in FIG. 20.

Further, since the deflection yoke of this Example does not have an inflection point at the screen side flange portion 40 of the horizontal deflection coil 45 unlike conventional arts, problems such as the damage in production to the coil wires at the time of winding the horizontal deflection coil 45 as well as the contact of the horizontal deflection coil 45, the vertical deflection coil 46 and the ferrite core 47 with each other at the time of assembling the deflection yoke can be prevented.

Although the screen side flange portion 40 of the horizontal deflection coil 45 is formed to have a dent with the dent size b of 15 mm away from the maximum projection line 42 of the screen side flange portion 40, the size is not limited thereto.

Further, although the embodiment wherein the screen side flange portion 24 of the saddle shaped horizontal deflection coil 30 is formed to have a projection toward the screen side, or the embodiment wherein the screen side flange portion 40 of the horizontal deflection coil 45 is formed to have a dent toward the electron gun side are described in the above mentioned Example 5 and Example 6, the present invention is not limited to these embodiments. And the same effect of reducing a high order raster distortion can be achieved in an embodiment wherein the screen side flange portion of the saddle shaped vertical deflection coil 31 is formed to have a projection toward the screen side, or an embodiment wherein the screen side flange portion of the saddle shaped vertical deflection coil 46 is formed to have a dent toward the electron gun side.

EXAMPLE 7

Figure 22:
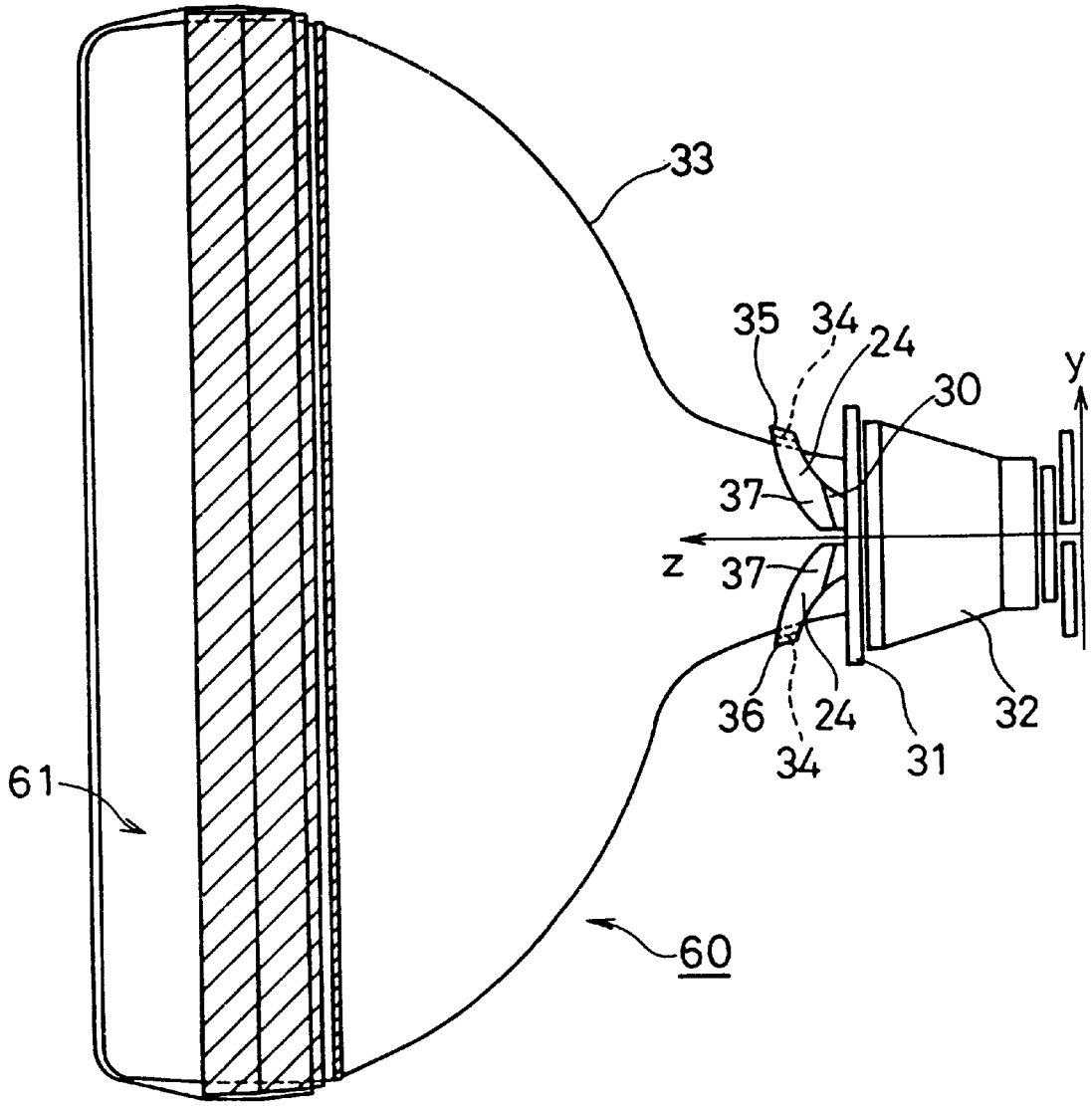
FIG. 22 is a plan view of a cathode ray tube of Example 7 of the present invention.

FIG. 22 is a plan view illustrating the seventh Example of color cathode ray tubes of the present invention. As can be seen in FIG. 22, the color cathode ray tube main body 60 comprises glass panel portion 61, and glass funnel portion 33 connected to the rear part of the glass panel portion 61. An electron gun (not shown in FIG. 22) is provided behind the glass funnel portion 33. The deflection yoke, comprising the saddle shaped horizontal deflection coil 30, the saddle shaped vertical deflection coil 31 located outside the horizontal deflection coil 30 and the ferrite core 32 located outside the vertical deflection coil 31, is located in the rear periphery of the glass funnel portion 33. That is, the deflection yoke with the structure shown in Example 5 is used in the color cathode ray tube of this Example (see FIG. 13, FIG. 14). The screen side flange portion 24 of the horizontal deflection coil 30 is formed to have a projection toward the screen side with the top portion at the point crossing the tube axis (Z axis) 25. The projection size a is set to be 30 mm away from the maximum projection line 27 of the screen side cone portion 26. The deflection yoke with the structure described in the above mentioned fifth Example is used and the fifth-order barrel distortion is emphasized to have a preferable linear raster distortion at the upper and lower portions without a high order distortion when the distortion conditions of the horizontal magnetic field include the fifth-order pincushion distortion.

Although the deflection yoke with the structure described in the above mentioned Example 5 is used in this Example, the structure of the yoke is not limited thereto. When the distortion condition of the horizontal magnetic field distribution includes the fifth-order barrel distortion, by using the deflection yoke with the structure described in the above mentioned Example 6, the fifth-order pincushion distortion is emphasized and the upper and lower raster distortion is corrected to be the preferable linear one without a high order distortion as mentioned above.

In general, the magnetic field at the screen side of a deflection yoke is much more sensitive than the magnetic field at the electron gun side with respect to controlling the raster distortion. Therefore, methods such as controlling the raster distortion in the magnetic field generated by the screen side flange portion of the saddle shaped coil are highly effective.

Figure 28:
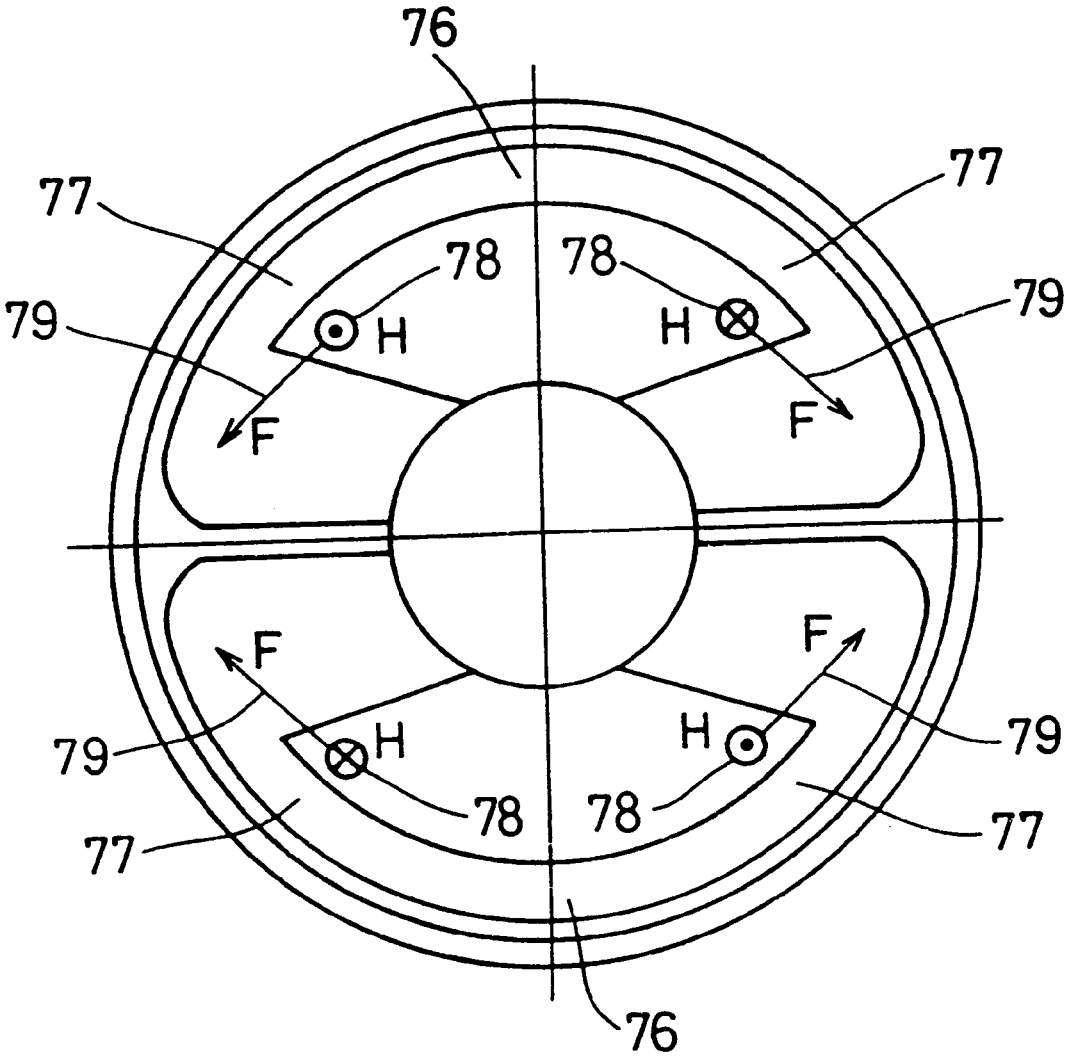
FIG. 28 is a diagram illustrating the magnetic field oriented to the tube axis generated at the vicinity of corner portions of the screen side flange portion of the horizontal deflection coil and the Lorentz's force applied on the electron beam when the electron beam is deflected on the screen corner portions of the color cathode ray tube of Example 8 of the present invention.

As described in FIG. 28, in deflecting the electron beam to the screen corner portions of the color cathode ray tube, the magnetic field to the tube axis direction 78 is generated in the vicinity of the corner portions 77 of the screen side flange portion 76 of the saddle shaped horizontal deflection coil to apply the Lorentz's force 79 to the electron beam. The embodiments described in detail in the following Example 8 and the Example 9 are achieved with paying attention to the magnetic field to the tube axis direction 78 generated in the vicinity of the corner portions 77 of the screen side flange portion 76. That is, by having the shape of the screen side flange portion 76 of an approximately circular shape when viewed from the screen side with the designated ratio of the maximum width to the maximum height greater, the strength of the magnetic field to the tube axis direction 78 is intensified to reduce the high order raster distortion at the screen corners.

EXAMPLE 8

Figure 23:
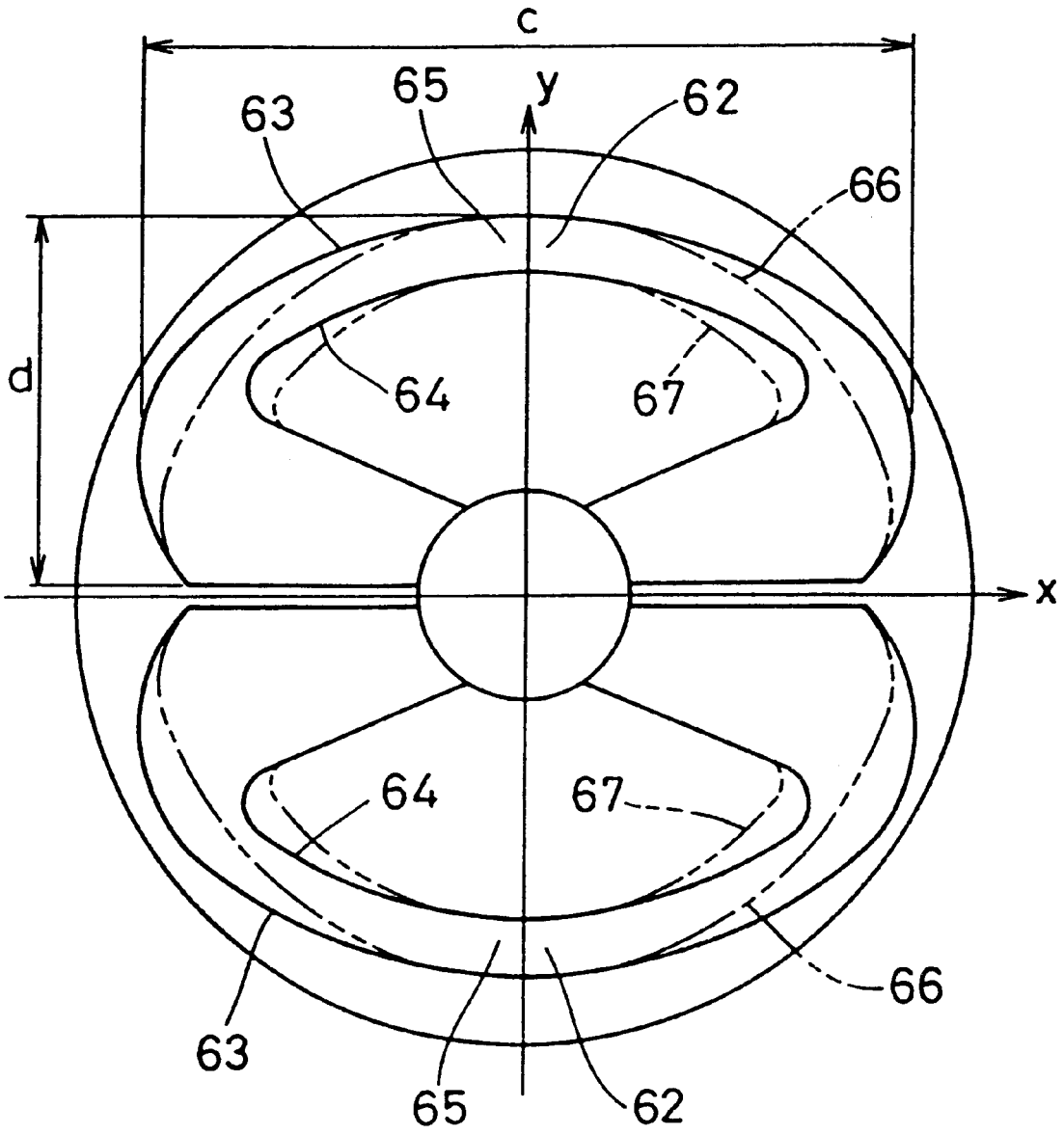
FIG. 23 is a diagram of a deflection yoke of Example 8 of the present invention viewed from the screen side.
Figure 24:
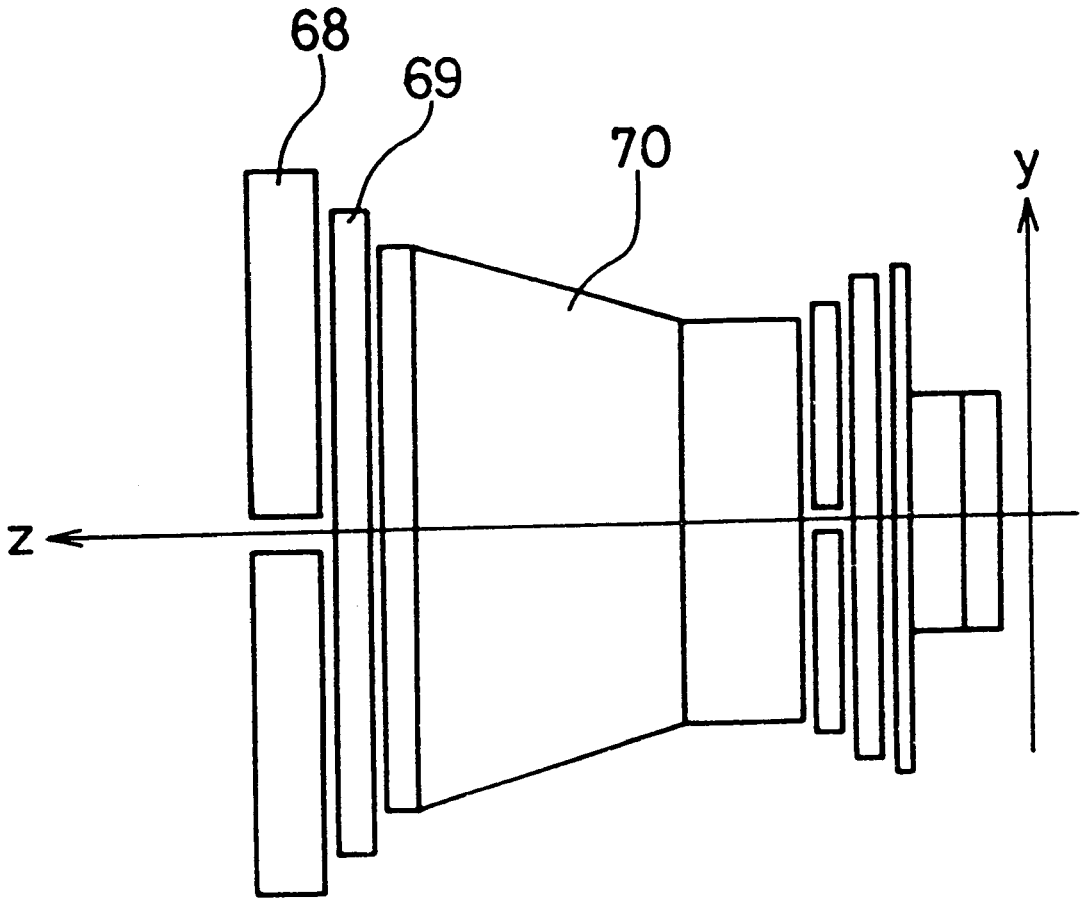
FIG. 24 is a plan view of a deflection yoke of FIG. 23.

FIG. 23 is a diagram illustrating the eighth Example of deflection yokes of the present invention viewed from the screen side and FIG. 24 is a plan view of the deflection yoke of FIG. 23. As can be seen in FIG. 24, the deflection yoke comprises the saddle shaped wound horizontal deflection coil 58, the saddle shaped vertical deflection coil 69 located outside the horizontal deflection coil 68, and the ferrite core 70 located outside the vertical deflection coil 69.

As described in FIG. 23, the screen side flange portion 62 of the horizontal deflection coil 68 has the contour 63, 64 of smoothly curved lines and the ratio r=c/d (c the maximum size of the width direction (x axis direction), d: the maximum height (y axis direction)) is set to be 2.75.

The shape of the contour of the screen side flange portion 65 of conventional horizontal deflection coils is described by the chain double-dashed lines 66, 67 in FIG. 23. The value of the above mentioned r in this case is usually 2.0. In general, since the contour 66, 67 of the screen side flange portion 65 of conventional horizontal deflection coils is formed to conform to the shape of the opposing glass funnel portion of the cathode ray tube, it becomes circular in shape. The contour 66, 67 of the screen side flange portion 65 of the horizontal deflection coil is formed to conform to the surface of the glass funnel portion of the cathode ray tube in order to minimize the energy loss by placing the screen side flange portion 65 of the horizontal deflection coil close to the electron beam.

Figure 25:
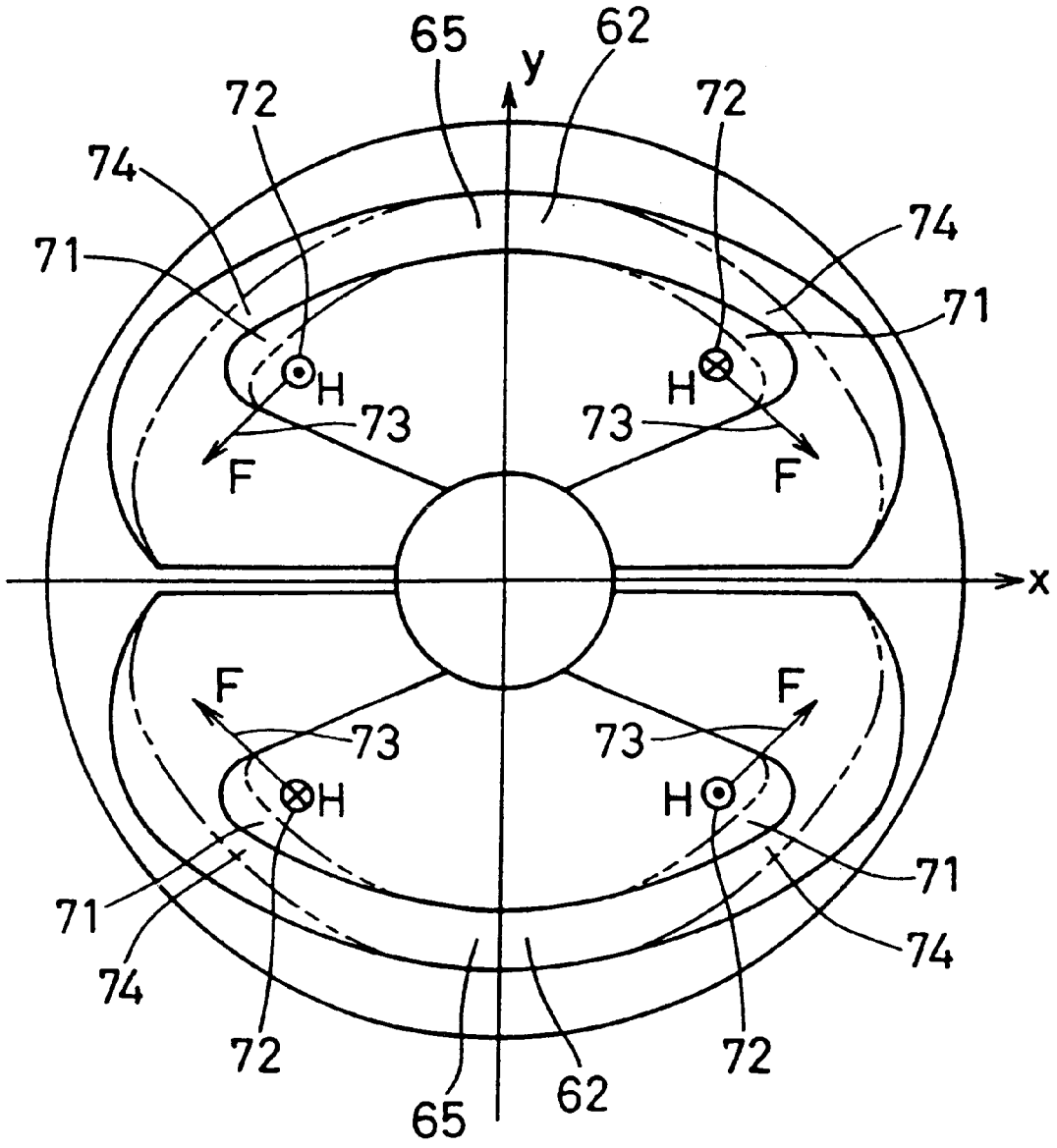
FIG. 25 is a diagram illustrating the magnetic field oriented to the tube axis generated at the vicinity of corner portions of the screen side flange portion of the horizontal deflection coil and the Lorentz's force applied on the electron beam when the electron beam is deflected on the screen corner portions of the color cathode ray tube of Example 8 of the present invention.

As described in FIG. 25, in deflecting the electron beam to the screen corner portion of the color cathode ray tube, the magnetic field to the tube axis direction 72 is generated in three vicinity of the corner portions 74 of the screen side flange portion 62 of the horizontal deflection coil 68 to apply the Lorentz's force to the electron beam. However, if the contour 66, 67 of the screen side flange portion 65 of a horizontal deflection coil has a circular shape like conventional arts, since the screen side flange portion 65 is placed closer to the electron beam, the strength of the magnetic field applied to the electron beam 72 becomes very strong. As a result, since the Lorentz's force applied to the electron beam becomes greater as well, the high order raster distortion 75 is generated at screen corner portions as described in FIG. 26. The amount of distortion e becomes 0.6 mm in a 41 cm (17")–90° color cathode ray tube, thus the image quality is drastically deteriorated.

Figure 26:
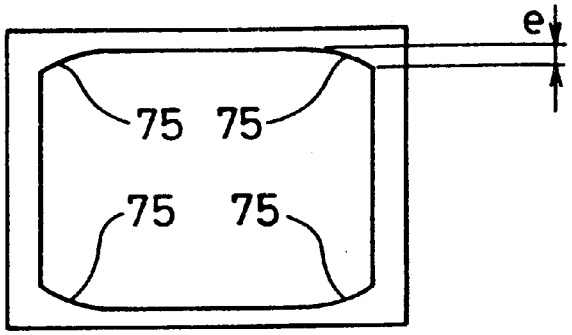
FIG. 26 is a diagram illustrating a high order raster distortion at the screen corners in Example 8 of the present invention.

On the other hand, in the horizontal deflection coil 68 with the contour 63, 64 of the screen side flange portion 62 of a smoothly curved line of this Example, if the ratio r=c/d (c: the maximum width (x axis direction), d: the maximum height (y axis direction)) of the screen side flange portion 62 is greater than 2.0, since the corner portions 74 of the screen side flange portion 62 become farther from the glass funnel portion as described in FIG. 25, the strength of the magnetic field to the tube axis direction 72 generated at the portions becomes weaker relative to conventional circular shaped ones. As a result, since the Lorentz's force 73 applied on the electron beam becomes weaker as well, the high order raster distortion 75 at screen corner portions described in FIG. 26 is reduced.

Figure 27:
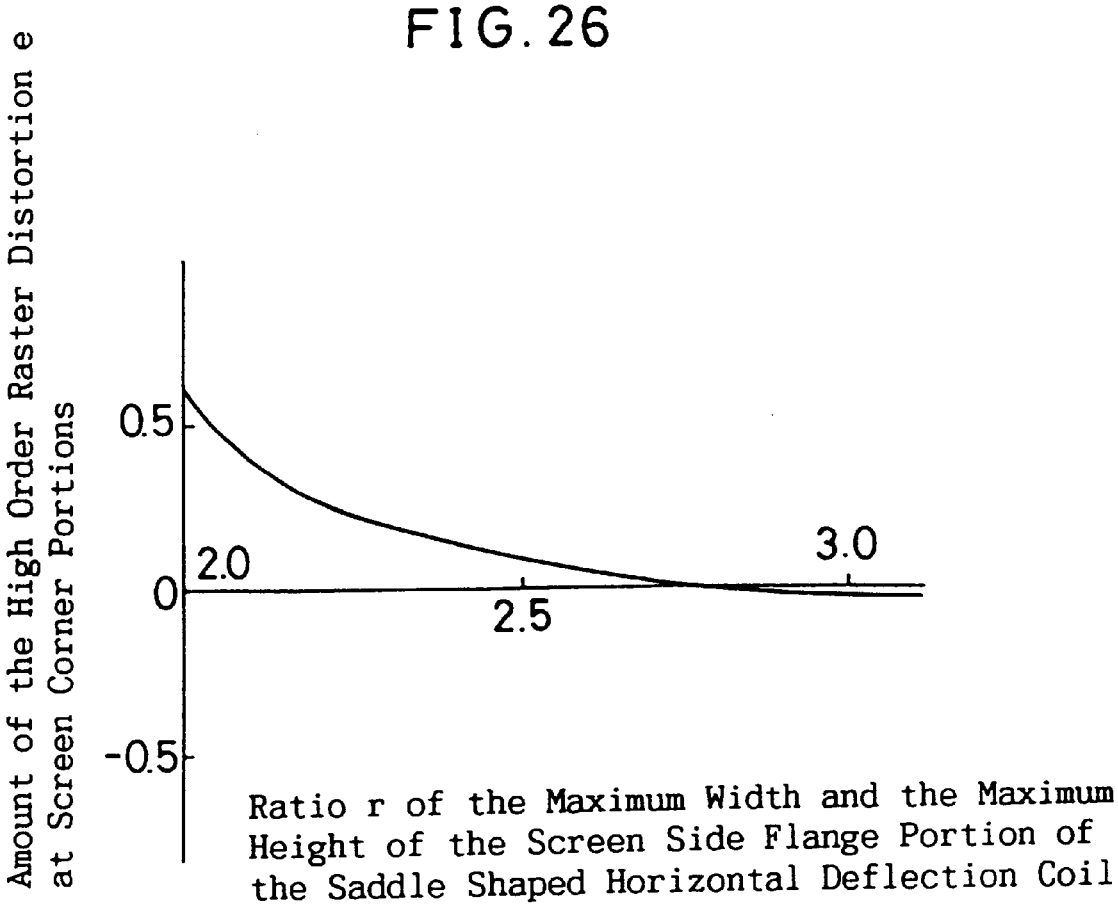
FIG. 27 is a graph illustrating the relationship between the ratio of the maximum width and the maximum height of the screen side flange portion of the saddle shaped horizontal deflection coil r and the amount of a high order raster distortion c in Example 8 of the present invention.

The relationship between the ratio r=c/d (c: the maximum width, d: the maximum height) of the screen side flange portion 62 of the horizontal deflection coil 68 and the amount of the raster distortion e at screen corners is examined with a 41 cm (17")–90° color cathode ray tube. The result is illustrated in FIG. 27. As can be seen in FIG. 27, the amount of the high order raster distortion e at screen corner portions e becomes 0 when r=2.75. That is, in a horizontal deflection coil 68 with the contour 63, 64 of the screen side flange portion 62 of a smoothly curved line, by setting the ratio r=c/d of the screen side flange portion 62 to be 2.75, the high order raster distortion at screen corner portions of a 41 cm (17") –90° color cathode ray tube can be eliminated.

Although the value for the ratio r=c/d of the screen side flange portion 62 of the horizontal deflection coil 68 of 2.75 is used in this Example, the value is not limited thereto and the value of r can be in the range from 2.2 to 3.5. When the value of r is 2.2 or more, since the amount of the high order raster distortion e at screen corner portions becomes 0.3 mm or less (see FIG. 27), and there would be no practical problems. On the other hand, if the amount of r is greater than 3.5, a high order raster distortion is generated in the direction opposite to that of FIG. 26, which is not preferable.

Further, although the embodiment wherein the screen side flange portion 62 of the horizontal deflection coil 68 has the contour of smoothly curved lines and the ratio r=c/d (c: the maximum size of the width direction, d: the maximum height) is set to be in the range from 2.2 to 3.5, the present invention is not limited to the embodiment. And the same effect of reducing a high order raster distortion can be achieved in an embodiment wherein the screen side flange portion of the saddle shaped vertical deflection coil 69 has the contour of smoothly curved lines and the ratio r=c/d (c: the maximum size of the width direction, d: the maximum height) is set to be in the range from 2.2 to 3.5.

EXAMPLE 9

Figure 29:
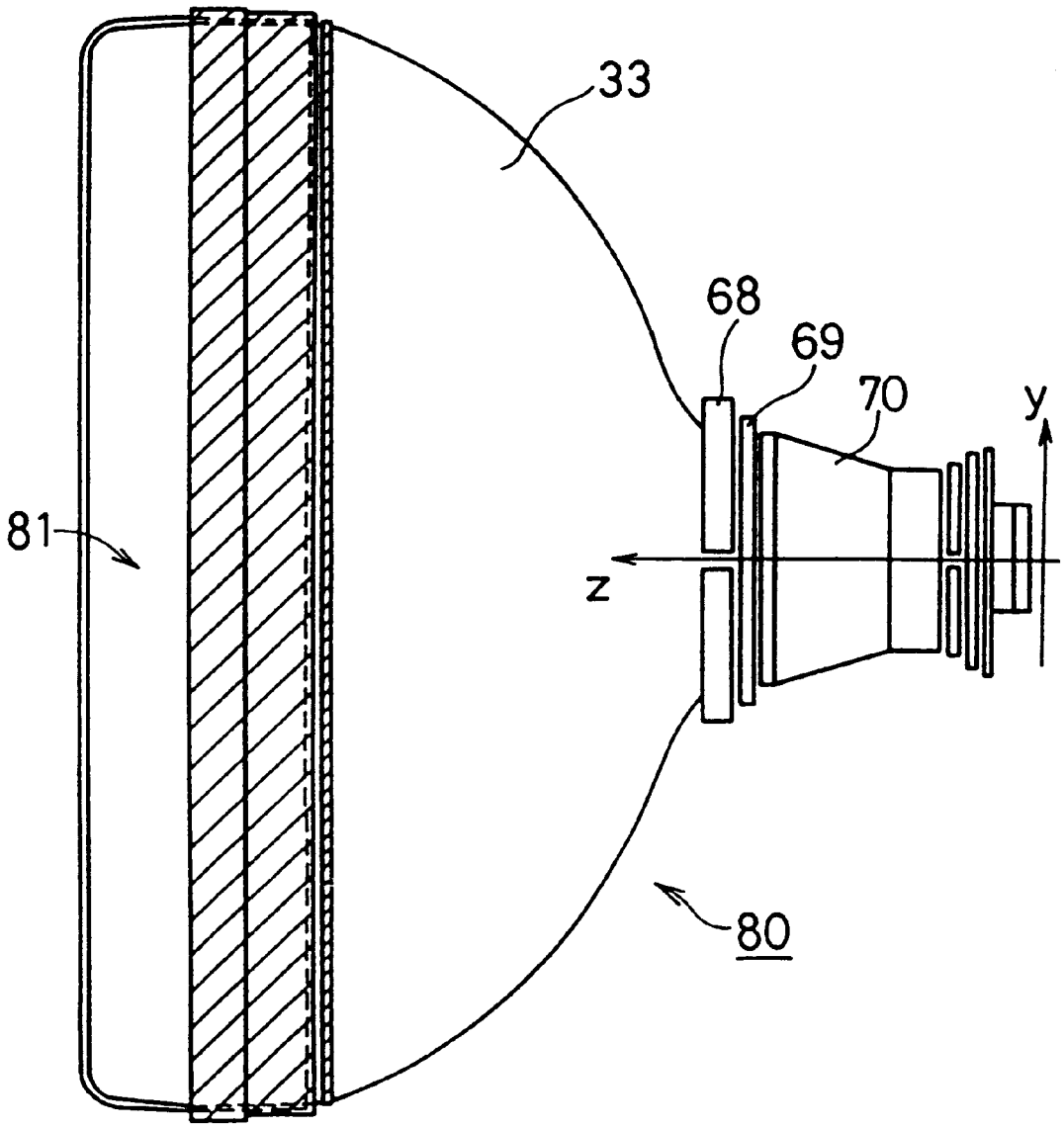
FIG. 29 is a plan view of a color cathode ray tube of Example 9 of the present invention.

FIG. 29 is a plan view illustrating the ninth Example of color cathode ray tubes of the present invention. As can be seen in FIG. 29, the color cathode ray tube main body 80 comprises the glass panel portion 81, and glass funnel portion 33 located to the rear part of the glass panel portion 81. An electron gun (not shown in FIG. 29) is provided behind the glass funnel portion 33. The deflection yoke, comprising the saddle shaped horizontal deflection coil 68, the saddle shaped vertical deflection coil 69 located outside the horizontal deflection coil 68 and the ferrite core 70 located outside the vertical deflection coil 69, is located in the rear periphery of the glass funnel portion 33. That is, the deflection yoke with the structure shown in Example 8 is used in the color cathode ray tube of this Example (see FIG. 23, FIG. 24). The screen side flange portion 62 of the horizontal deflection coil 68 is formed to have a contour 63, 64 of a smoothly curved line with the ratio r=c/d (c:the maximum width, d the maximum height) of the screen side flange portion 62 of the horizontal deflection coil 68 is set to be 2.75. Since the deflection yoke with the structure described in the above mentioned Example 8 is used and the high order raster distortion 75 is reduced at screen corner portions as described above, the image quality of the color cathode ray tube is improved.

Although the case with the ratio r=c/d of the screen side flange portion 62 of the horizontal deflection coil 68 of 2.75 is used in this Example, the value is not limited thereto and the value of r can be in the range of from 2.2 to 3.5.

As mentioned above, in general, the screen side magnetic field of a deflection yoke is much more sensitive than the electron gun side magnetic field with respect to controlling a raster distortion. Therefore, a method of controlling a raster distortion by the magnetic field generated by the screen side flange portion of a saddle shaped coil is highly effective. As described in FIG. 28, in deflecting the electron beam to the screen corner portion of the color cathode ray tube, the magnetic field to the tube axis direction 78 is generated in the vicinity of the corner portions 77 of the screen side flange portion 76 of the saddle shaped horizontal deflection coil to apply the Lorentz's force 79 to the electron beam. The embodiments described in detail in the following Example 10 and the Example 11 are achieved with paying attention to the magnetic field to the tube axis direction 78 generated in the vicinity of the corner portions 77 of the screen side flange portion 76. That is, by having a gap portion in the upper and lower direction through the screen side flange portion 76 of the saddle shaped horizontal deflection coil, the strength of the magnetic field to the tube axis direction 78 is weakened to reduce the high order raster distortion at the screen surface.

EXAMPLE 10

Figure 30:
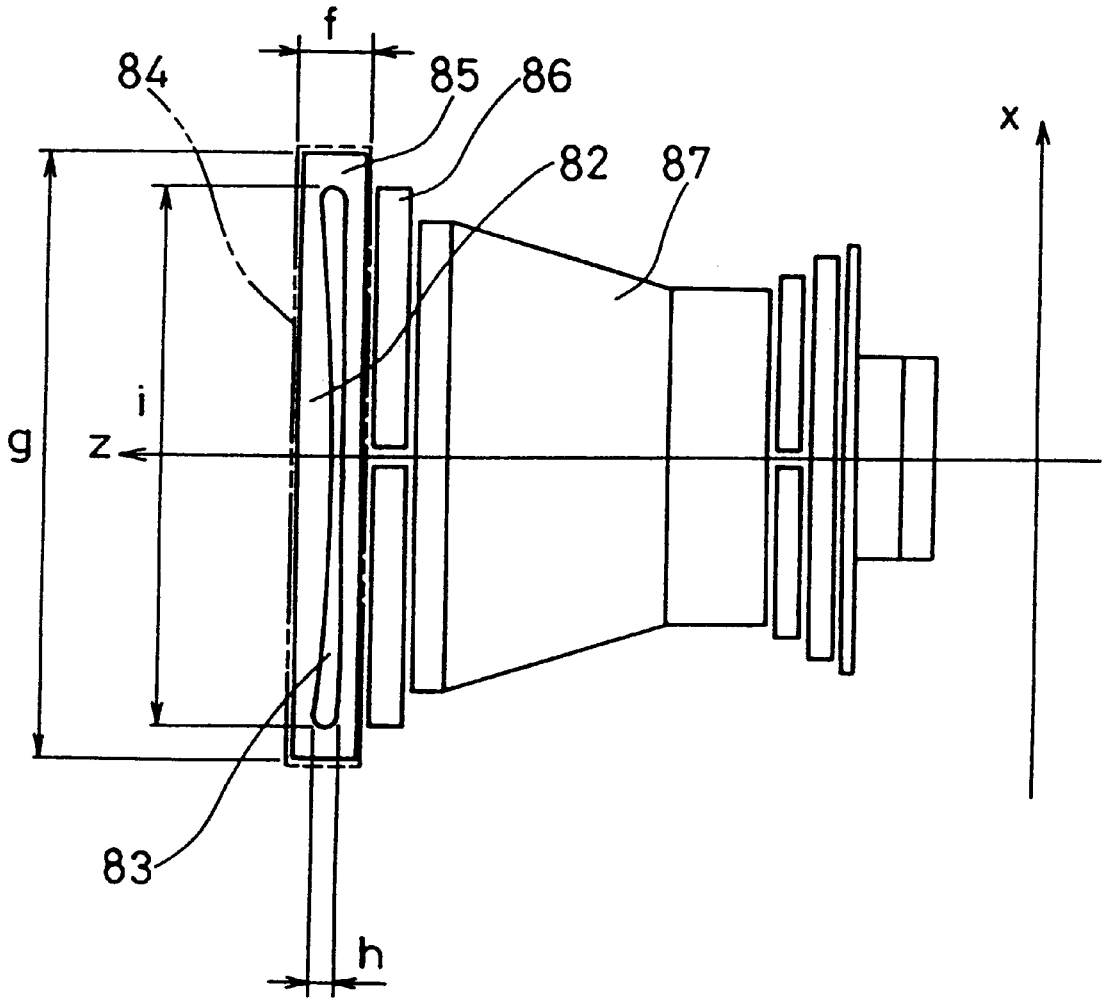
FIG. 30 is a plan view of a deflection yoke of Example 10 of the present invention.
Figure 31:
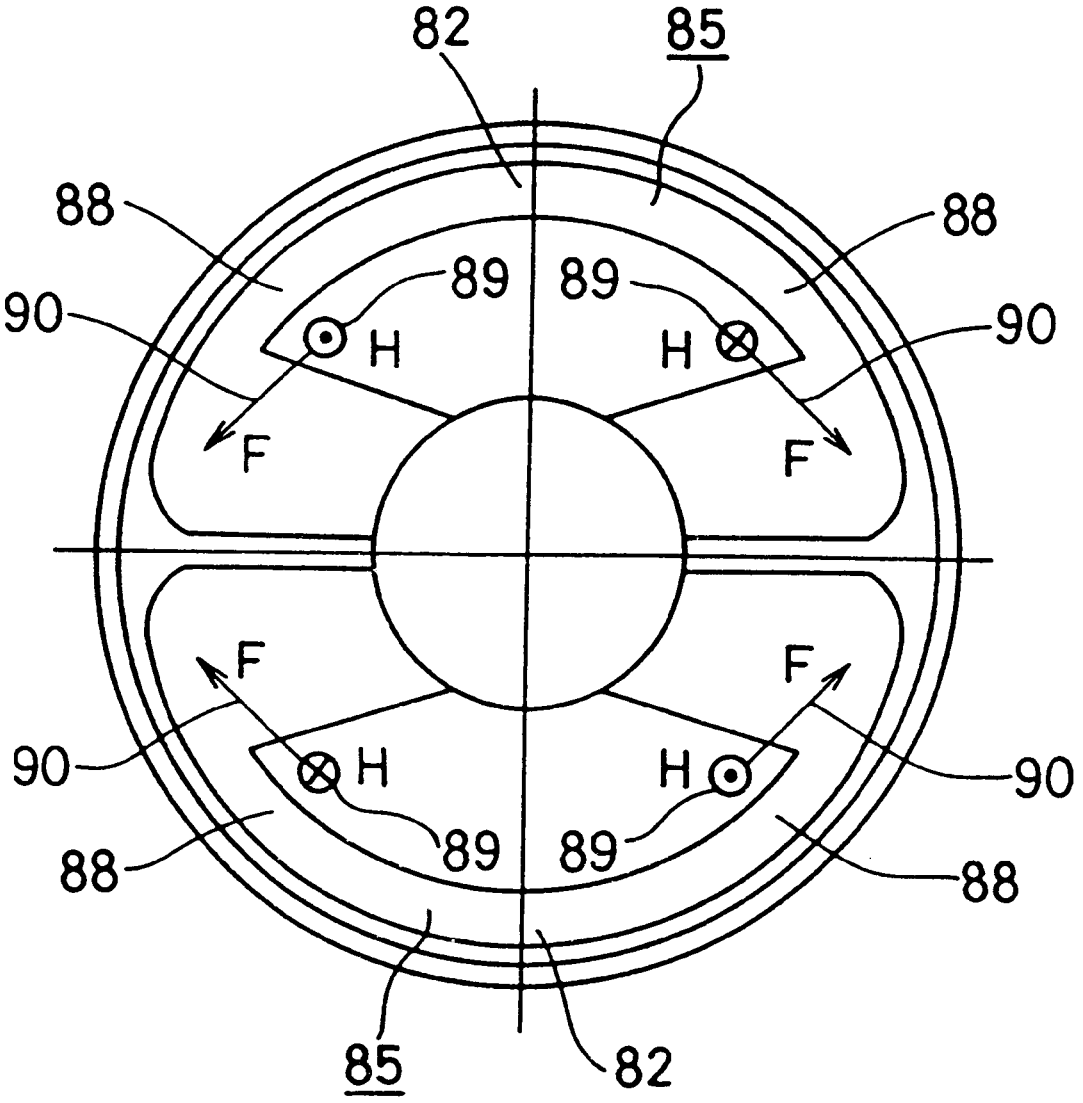
FIG. 31 is a diagram of the deflection yoke of FIG. 30 viewed from the screen side.

FIG. 30 is a plan view illustrating the tenth Example of deflection yokes of the present invention and FIG. 31 is a diagram of the deflection yoke of FIG. 30 viewed from the screen side. As can be seen in FIG. 30, the deflection yoke comprises the saddle shaped horizontal deflection coil 85, the saddle shaped vertical deflection coil 86 located outside the horizontal deflection coil 86, and the ferrite core 87 located outside the vertical deflection coil 86.

The screen side flange portion 82 of the horizontal deflection coil 85 has a maximum size in the tube axis direction (z axis direction) f of 20 mm and a maximum size in the horizontal direction (x axis direction) g of 120 mm and the contour viewed from the screen side of approximately circular shape as described in FIG. 31. The screen side flange portion 82 of the horizontal deflection coil 85 has a gap portion 83 in the upper and lower direction therethrough. Here the gap portion 83 is set to have a maximum size in the tube axis direction h of 5 mm, and a maximum size in the horizontal direction i of 80 mm.

The shape of the conventional screen side flange portion of a horizontal deflection coil is described by the chain double-dashed line 84 in FIG. 30. The contour is approximately the same as that of the screen side flange portion 82 of this Example but they are different for having the gap portion formed therethrough in the upper and lower direction in this Example.

As described in FIG. 31, in deflecting the electron beam to the screen corner portion of the color cathode ray tube, the magnetic field to the tube axis direction 89 is generated in the vicinity of the corner portions 88 of the screen side flange portion 82 of the horizontal deflection coil 85 to apply the Lorentz's force 90 to the electron beam. However, if the contour of the screen side flange portion of a horizontal deflection coil is the above mentioned conventional shape, since the strength of the magnetic field 89 is very strong, the Lorentz's force 90 applied to the electron beam becomes greater as well. As a result, the raster distortion 91 is generated at the upper and lower edges of the screen as described in FIG. 32. The amount of the distortion j becomes 0.7 mm in the 51 cm (21") –90° color cathode ray tube, and thus the image quality becomes drastically deteriorated.

Figure 32:
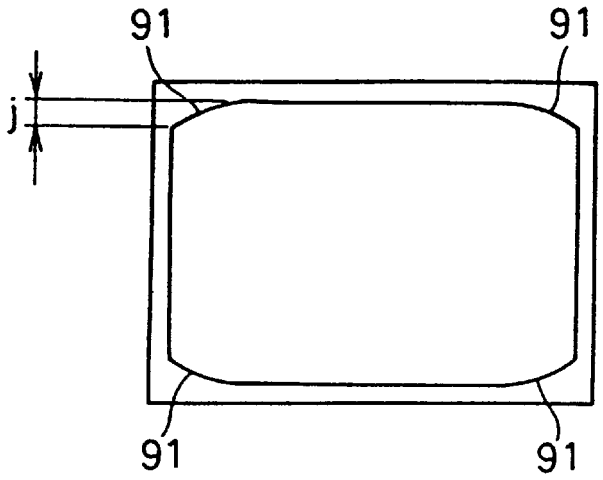
FIG. 32 is a diagram illustrating a high order upper and lower raster distortion of the screen surface in Example 10 of the present invention.

On the other hand, if a gap portion 83 is formed in the upper and lower direction through the screen side flange portion 82 of the horizontal deflection coil 85 as in this Example, since coil wires do not exist in the gap portion 83, the strength of the magnetic field to the tube axis direction 89 generated in the vicinity of corner portions 88 of the screen side flange portion 82 of the horizontal deflection coil 85 becomes weak. As a result, since the Lorentz's force 90 applied on the electron beam becomes weak as well, the high order upper and lower raster distortion 91 in the screen surface described in FIG. 32 is reduced.

Figure 33:
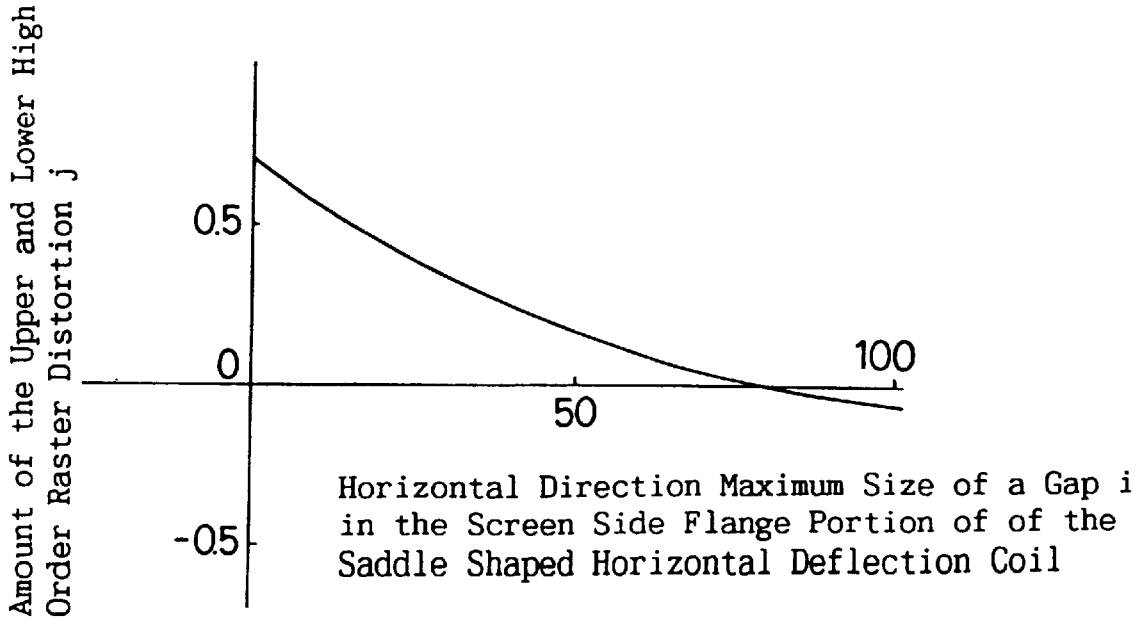
FIG. 33 is a graph illustrating the relationship between the maximum size of the gap portion and a high order upper and lower raster distortion of the screen surface in Example 10 of the present invention.

With the maximum size in the tube axis direction h of the gap portion 83 fixed to be 5 mm, the relationship between the maximum size in the horizontal direction i of the gap portion 83 and the amount of the high order distortion of the upper and lower edges of the screen j is examined with a 51 cm (21") −90° color cathode ray tube. The result is illustrated in FIG. 33. As can be seen from FIG. 33, the amount of the high order upper and lower raster distortion j at screen surface becomes 0 when the maximum size in the horizontal direction i is 80 mm. That is, when a gap portion 83 is formed in the upper and lower direction through the screen side flange portion 82 of the horizontal deflection coil 85 having an approximately circular shape viewed from the screen side, a maximum size in the tube axis direction f of 20 mm and a maximum size in the horizontal direction of 120 mm, the high order upper and lower raster distortion on the screen surface of a 51 cm (21") −90° color cathode ray tube can be eliminated with a maximum gap size in the tube axis direction h of 5 mm and a maximum gap size in the horizontal direction i 80 mm.

Although the contour of the screen side flange portion 82 of the horizontal deflection coil 85 viewed from the screen side is an approximately circular shape in this Example, the shape is not limited thereto. Further, the maximum size to the tube axis direction f, the maximum contour size to the horizontal direction g of the screen side flange portion 82 of the horizontal deflection coil 85, and the size to the tube axis direction h of the gap portion 83 are not limited to the amounts described in this Example. That is, forming a gap portion 83 in the upper and lower direction through the screen side flange portion 82 of the horizontal deflection coil 85 is the important feature of this Example.

EXAMPLE 11

Figure 34:
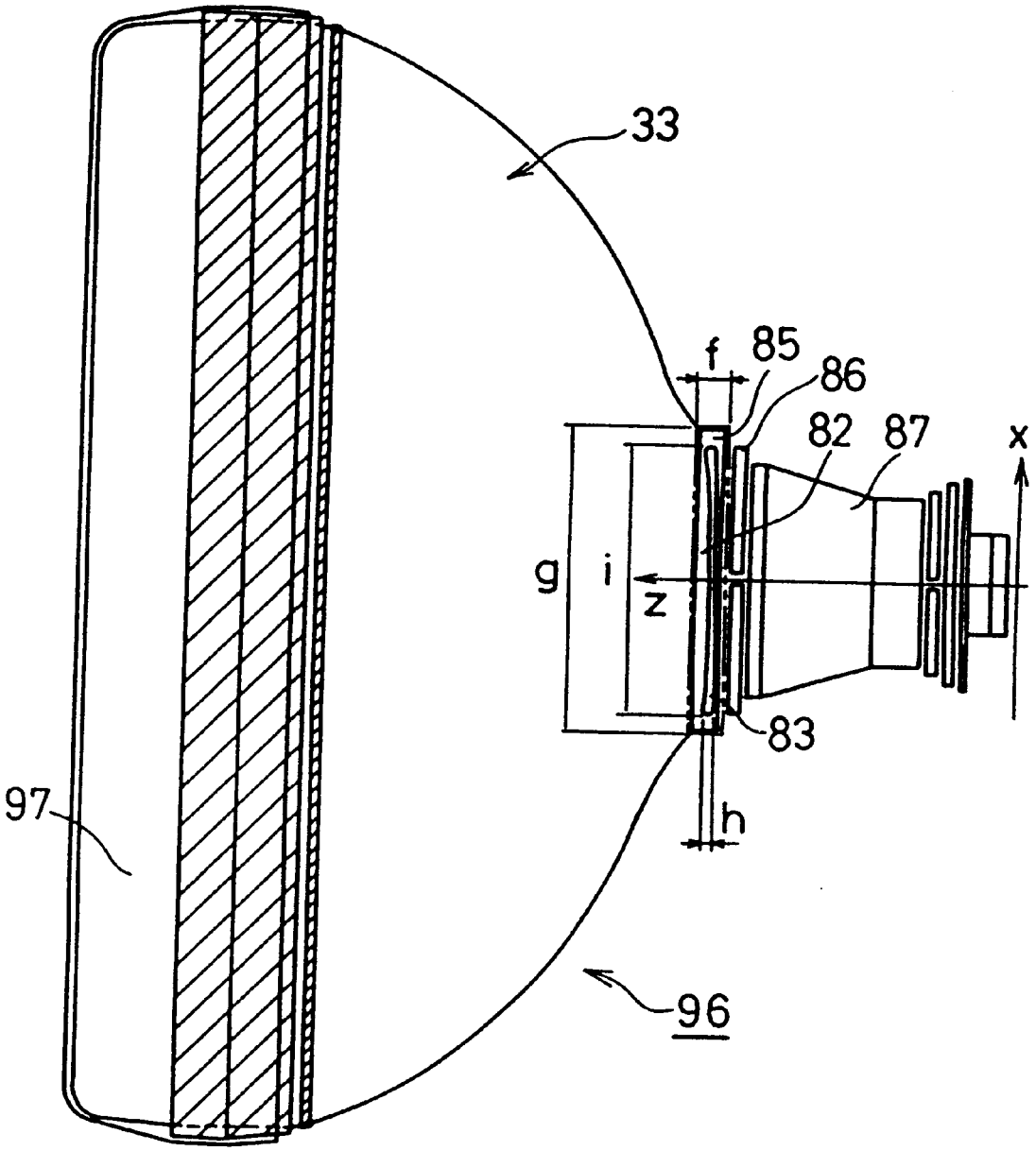
FIG. 34 is a plan view of a color cathode ray tube of Example 11 of the present invention.

FIG. 34 is a plan view illustrating the eleventh Example of color cathode ray tubes of the present invention. As can be seen in FIG. 34, the color cathode ray tube main body 96 comprises glass panel portion 97, and glass funnel portion 33 connected to the rear part of the glass panel portion 97. An electron gun (not shown in FIG. 34) is provided behind the glass funnel portion 33. The deflection yoke, comprising the saddle shaped horizontal deflection coil 85, the saddle shaped vertical deflection coil 86 located outside the horizontal deflection coil 85 and the ferrite core 87 located outside the vertical deflection coil 86, isolated in the rear periphery of the glass funnel portion 33. The screen side flange portion 82 of the horizontal deflection coil 85 has a gap portion 83 therethrough in the upper and lower direction. Here the gap portion 83 is set to have a maximum size in the tube axis direction h of 5 mm and a maximum size in the horizontal direction i of 80 mm. That is, the deflection yoke with the structure shown in Example 10 is used in the color cathode ray tube of this Example (see FIG. 30, FIG. 31). Since the deflection yoke with the structure described in the above mentioned Example 10 is used and the screen surface becomes a preferable straight linear one without the high order upper and lower raster distortion as described above, the image quality of the color cathode ray tube is improved.

Although the shape of the screen side flange portion 82 of the horizontal deflection coil 85 viewed from the screen side is an approximately circular one also in this Example, the shape is not limited thereto. The amount of the maximum size in the tube axis direction f and the maximum contour size in the horizontal direction g of the screen side flange portion 82 of the horizontal deflection coil 85, and the size in the tube axis direction h and the horizontal direction i of the gap portion 83 are not limited to those described in this Example.

We claim:

1. A deflection yoke comprising a saddle shaped horizontal deflection coil, a saddle shaped vertical deflection coil located outside the saddle shaped horizontal deflection coil, and a core located outside the saddle shaped vertical deflection coil, wherein a screen side flange portion of the horizontal deflection coil has a gap therethrough in the upper and lower direction, and wherein the screen side flange portion is an arch-shaped portion provided at a screen side end of the horizontal deflection coil.

2. A color cathode ray tube comprising:

a color cathode ray tube main body that comprises a glass panel portion and a glass funnel portion connected to a rear part of the glass panel portion;

an electron gun located at a rear part of the color cathode ray tube main body; and a deflection yoke comprising:

a saddle shaped horizontal deflection coil located at a rear periphery of the color cathode ray tube main body;

a saddle shaped vertical deflection coil located outside the saddle shaped horizontal deflection coil;

a core located outside the saddle shaped vertical deflection coil; and wherein a screen side flange portion of the horizontal deflection coil has a gap therethrough in the upper and lower direction, and wherein the screen side flange portion is an arch-shaped portion provided at a screen side end of the horizontal deflection coil.

* * * * *